US007968264B2

(12) United States Patent
Hongo et al.

(10) Patent No.: US 7,968,264 B2
(45) Date of Patent: Jun. 28, 2011

(54) ELECTROPHOTOGRAPHIC PHOTORECEPTOR, PROCESS CARTRIDGE AND IMAGE-FORMING APPARATUS

(75) Inventors: Kazuya Hongo, Kanagawa (JP); Yukiko Kamijo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 656 days.

(21) Appl. No.: 12/073,441

(22) Filed: Mar. 5, 2008

(65) Prior Publication Data

US 2008/0261136 A1 Oct. 23, 2008

(30) Foreign Application Priority Data

Apr. 19, 2007 (JP) ..... 2007-110008

(51) Int. Cl.
*G03G 5/00* (2006.01)

(52) U.S. Cl. ..... 430/59.4; 430/83; 430/58.05; 399/159

(58) Field of Classification Search ..... 430/59.4, 430/83, 58.05; 399/159
See application file for complete search history.

(56) References Cited

U.S. PATENT DOCUMENTS 4,218,528 A * 8/1980 Shimada et al. ..... 430/76
5,302,479 A 4/1994 Daimon et al.
5,372,906 A * 12/1994 Haneda et al. ..... 430/119.81
5,474,868 A * 12/1995 Adachi et al. ..... 430/58.05
7,282,636 B2 * 10/2007 Funaoka et al. ..... 136/263
2006/0035392 A1 * 2/2006 Funaoka et al. ..... 438/12

FOREIGN PATENT DOCUMENTS

| | | |
|---|---|---|
| JP | A-2-233701 | 9/1990 |
| JP | A-5-34954 | 2/1993 |
| JP | A-5-263007 | 10/1993 |
| JP | A-6-51545 | 2/1994 |
| JP | A-7-104465 | 4/1995 |
| JP | A-7-104495 | 4/1995 |
| JP | A-9-278904 | 10/1997 |
| JP | A-2001-64494 | 3/2001 |
| JP | A-2001-131201 | 5/2001 |
| JP | A-2001-261839 | 9/2001 |
| JP | A-2002-107972 | 4/2002 |
| JP | A-2004-39901 | 2/2004 |
| JP | A-2004-137347 | 5/2004 |
| JP | A-2004-265622 | 9/2004 |
| JP | A-2005-37780 | 2/2005 |
| JP | A-2005-208619 | 8/2005 |
| JP | A-2005-288254 | 10/2005 |

* cited by examiner

*Primary Examiner* — Mark A Chapman
(74) *Attorney, Agent, or Firm* — Oliff & Berridge, PLC

(57) ABSTRACT

An electrophotographic photoreceptor includes a conductive substrate; and a photosensitive layer that includes a phthalocyanine pigment, a charge-transporting substance and at least one kind of lignophenol derivative.

6 Claims, 13 Drawing Sheets

ELECTROPHOTOGRAPHIC PHOTORECEPTOR, PROCESS CARTRIDGE AND IMAGE-FORMING APPARATUS

CROSS-REFERENCE TO RELATED APPLICATIONS

This application is based on and claims priority under 35 USC 119 from Japanese Patent Application No. 2007-110008 filed on Apr. 19, 2007.

BACKGROUND

1. Technical Field

The present invention relates to an electrophotographic photoreceptor, a process cartridge and an image-forming apparatus.

2. Related Art

An electrophotographic apparatus (image-forming apparatus) provides prints at high speed with high quality and is therefore utilized in copying machines and laser printers (laser beam printer). In recent years, there is an increasing demand for the image-forming apparatus to perform higher functions, provide higher image quality, permit reduction of production cost, and have more resistance against environment conditions and, therefore, an electrophotographic photoreceptor which functions to form a latent image and a developed image in the electrophotographic process is also being required to have similarly higher performance. In order to meet such requirements, research and development and commercialization of organic photoreceptors using an organic photo-conductive material have recently been a main trend. With respect to structure, single-layer type photoreceptors are being replaced by function separation type photoreceptors, and this has served to successfully improve performance of such photoreceptors and make them practicable. With the function separation type photoreceptors, currently in many cases, an undercoat layer is first formed on an aluminum substrate, and then a photosensitive layer composed of a charge-generating layer and a charge-transporting layer is formed thereon.

SUMMARY

According to an aspect of the invention, there is provided an electrophotographic photoreceptor including a conductive substrate; and a photosensitive layer that includes a phthalocyanine pigment, a charge-transporting substance and at least one kind of lignophenol derivative.

BRIEF DESCRIPTION OF THE DRAWINGS

Exemplary embodiment(s) of the present invention will be described in detail based on the following figures, wherein.

DETAILED DESCRIPTION

Figure 1:
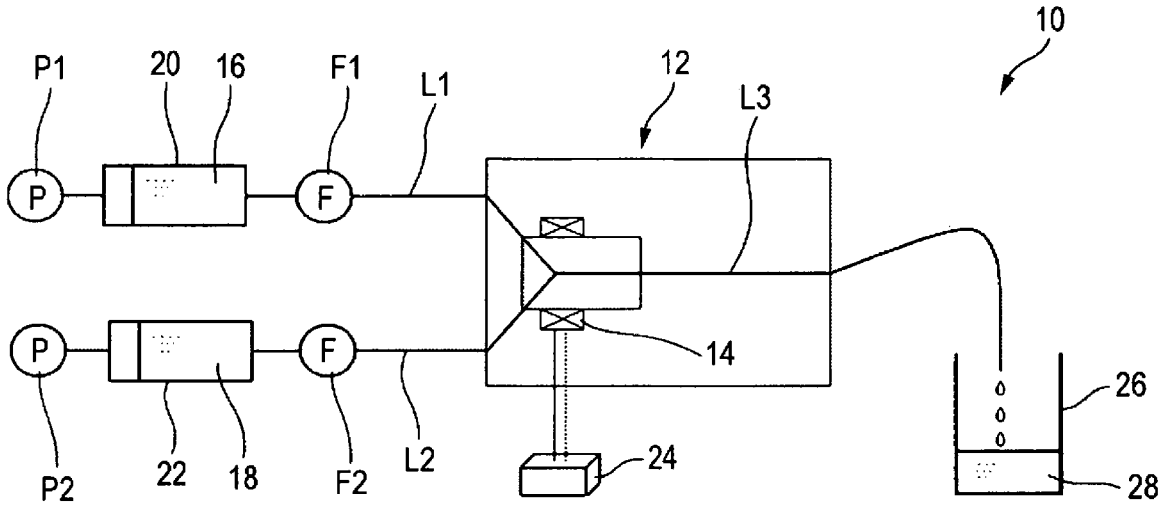
FIG. 1 is a view schematically showing the constitution of one example of a reaction apparatus having a micro-reactor which is used for the process for producing the lignophenol derivative.

The electrophotographic photoreceptor of the invention is characterized in having a photosensitive layer containing a phthalocyanine pigment, a charge-transporting substance and a lignophenol derivative on a conductive substrate.

Hereinafter, preferred exemplary embodiments of the invention will be described in detail by reference to drawings.

I. Electrophotographic Photoreceptor

The electrophotographic photoreceptor of the invention is characterized in having a photosensitive layer containing a phthalocyanine pigment, a charge-transporting substance and a lignophenol derivative on a conductive substrate.

The photosensitive layer in the electrophotographic photoreceptor of the invention may be constituted by a single layer or two or more layers, but is preferably a layer including a charge-generating layer and a charge-transporting layer superimposed one upon the other.

Hereinafter, the invention will be described in detail.

1. Lignophenol Derivatives

The photosensitive layer in the electrophotographic photoreceptor of the invention contains a lignophenol derivative.

The lignophenol derivatives not only function to reduce electrons remaining in the photosensitive layer, particularly electrons remaining when a phthalocyanine pigment is used, to thereby make it difficult to trap electrons, but also function as binders. Also, the lignophenol derivatives are natural materials which are extracted from plant resources and have biodegradable properties and are a biomass material which is excellent in environmental load and production cost, thus being extremely useful as a material for an electrophotographic photoreceptor which material takes safety and environment into consideration.

In the invention, the content of the lignophenol derivative contained in the photosensitive layer is preferably in the range of from about 0.00001 part by weight to about 3.0 parts by weight per part by weight of the aforesaid material of phthalocyanine pigment. When the content of the lignophenol derivative is within the above-described range, there can be obtained excellent photo-sensitivity, repeatability and environmental safety as well as sufficient chargeability and dark decay properties, thus image quality stable for a long period of time being obtained with sufficiently preventing image defects such as black points, fog, and ghost.

The term "lignophenol derivatives" as used in the invention means polymers which contain diphenylpropane units in such manner that phenol derivatives are introduced, through C—C bond, to the benzyl position (hereinafter also referred to as "side-chain α position") of phenylpropane units (hereinafter also referred to as "C9 units") of lignin.

The lignophenol derivatives to be used in the invention can be obtained, for example, by solvating a lignin-containing material with a phenol compound, adding an acid thereto, and mixing them. The amount and the molecular weight of the introduced phenol derivative in the lignophenol derivative vary depending upon kind of the lignocellulose material used as a starting material and upon reaction conditions.

As the lignin-containing material to be used in the invention, there can be illustrated wooden materials, various materials mainly including wood materials such as wood powder and wood chips and, in addition, agricultural or industrial wastes accompanying wood resources such as waste woods, waste woods from lumber mills, and waste-paper. Also, woods which can be used as the lignin-containing materials are not particularly limited, and any kinds of coniferous trees and broad-leaved trees can be used. Further, various grasses or weeds, materials related thereto such as agricultural wastes, and the like can be used as well. Still further, pulp black liquor which is produced in the production of pulp from woods can also be used.

As the phenol compounds to be used in the invention, there are illustrated monohydric phenol compounds, dihydric phenol compounds and trihydric phenol compounds.

As specific examples of the monohydric phenol compounds, there are illustrated phenols optionally having one or more substituents, naphthols optionally having one or more substituents, anthrols optionally having one or more substituents, and anthroquinonols optionally having one or more substituents.

As specific examples of the dihydric phenol compounds, there are illustrated catechols optionally having one or more substituents, resorcinols optionally having one or more substituents, and hydroquinones optionally having one or more substituents.

As specific examples of the trihydric phenol compounds, there are illustrated pyrogallols optionally having one or more substituents.

Kinds of the substituents which the phenol compounds optionally have are not particularly limited, and they may be any substituents. However, groups other than electron attractive groups (e.g., a halogen atom) are preferred, and examples thereof include an alkyl group (e.g., a methyl group, an ethyl group or a propylo group), an alkoxy group (e.g., a methoxy group, an ethoxy group or a propoxy group), and an aryl group (e.g., a phenyl group). Also, it is preferred that at least one of two o-positions with respect to the phenolic hydroxyl group in the phenol derivative be non-substituted.

The phenol compounds which can be used in the invention are preferably cresol, phenol, catechol, resorcinol and pyrogallol, with p-cresol being particularly preferred.

As the acids which can be used for production of the lignophenol derivatives, those acids are preferred which can swell cellulose. As specific examples of the acids, there can be illustrated sulfuric acid having a concentration of 60% by weight or more (for example, 72% by weight sulfuric acid), phosphoric acid having a concentration of 85% by weight or more, hydrochloric acid having a concentration of 38% by weight or more, p-toluenesulfonic acid, trifluoroacetic acid, trichloroacetic acid and formic acid, and it is preferred to use sulfuric acid having a concentration of 65% by weight or more.

As a process for producing the lignophenol derivatives which can be used in the invention, commonly known processes can be used with no particular limitations. For example, the lignophenol derivatives can be obtained by solvating the lignin-containing material with the phenol compound, adding the acid thereto, and then mixing them.

Additionally, salvation with the phenol compound can be performed by dipping the lignin-containing compound in the liquid phenol compound or, alternatively, by applying to the lignin-containing material a solution of the liquid or solid phenol compound in a solvent capable of dissolving the phenol compound, and then distilling off the solvent to thereby adsorbing the phenol compound onto the lignin-containing material.

As a specific example of the process for producing the lignophenol derivatives, there can be illustrated a process of permeating the liquid-state phenol compound into the lignin-containing material to thereby solvate lignin with the phenol compound, adding the acid to the lignin-containing material, and then mixing them to dissolve the cellulose component. According to this process, molecular weight of lignin is reduced and, at the same time, the lignophenol derivative is generated in the phenol compound phase in which derivative the phenol compound is introduced to the side-chain α position of phenylpropane units of lignin which are fundamental structural units of lignin. The lignophenol derivative is extracted from this phenol compound phase. The lignophenol derivative is obtained as an assembly of low-molecular products of lignin wherein benzyl aryl ether bonds in lignin are cleaved to undergo reduction in molecular weight.

Extraction of the lignophenol derivative from the phenol compound phase can be performed according to, for example, the following manner. That is, the phenol compound phase is added to a large excess of ethyl ether, and the precipitate thus obtained is collected, followed by dissolving it in acetone. The acetone-insoluble part is removed by centrifugation, and the acetone-soluble part is concentrated. The concentrated acetone-soluble part is dropwise added to a large excess of ethyl ether, and the precipitated fraction is collected. The solvent is distilled off from this precipitated fraction to thereby obtain the lignophenol derivative. Additionally, a crude lignophenol derivative can be obtained by merely subjecting the phenol compound phase or the acetone-soluble fraction to distillation under reduced pressure to remove the solvent.

Also, in the case where a solvent (e.g., ethanol or acetone) containing dissolved therein the solid-state or liquid-state phenol compound is permeated into the lignin-containing material and then the solvent is distilled off (adsorption of the phenol derivative), the lignophenol derivatives are produced similarly with the aforesaid process.

Alternatively, lignin is solvated with the phenol compound, the acid ia added to the lignin-containing material, the whole reaction solution is introduced into an excess of water, the insoluble fraction is collected by centrifugation and, after removing the acid, is dried. To this dried product is added acetone or alcohol to extract the lignophenol derivative. Further, the soluble fraction is dropwise added to a large excess of ethyl ether to obtain the lignophenol derivative as an insoluble fraction.

Specific examples of the process for preparing the lignophenol derivatives have been described hereinbefore. However, the process is not limited only to them, and it is possible to properly modify the process to prepare the lignophenol derivatives.

The lignophenol derivatives which can be used in the invention include second-order derivatives of the lignophenol derivatives.

The second-order derivatives of the lignophenol derivatives are derivatives which are obtained by further once subjecting the lignophenol derivative to a chemical modification. As the second-order derivatives of the lignophenol derivatives, derivatives obtained by, for example, once subjecting the lignophenol derivatives to one reaction selected from the group consisting of a reaction of introducing a protective group to the hydroxyl group, a reaction of introducing a substituent to the aromatic ring, and an alkali-treating reaction are preferred.

The lignophenol derivatives which can be used in the invention may be the lignophenol derivatives or the second-order derivatives of the lignophenol derivatives, with the lignophenol derivatives being more preferred.

The lignophenol derivatives show various properties due to presence of the phenolic hydroxyl group and the alcoholic hydroxyl group. Derivatives having different properties can be obtained by protecting these hydroxyl groups.

As the protective group, there can be illustrated commonly known protective groups, with an acyl group, a group having a carboxyl group, and a group having an amido group being preferred.

Also, the protective group may be introduced to part of, or to the whole of, the hydroxyl groups in the lignophenol derivatives, and may be introduced to either or both of the phenolic hydroxyl groups and the alcoholic hydroxyl groups.

In the case where an acyl group is introduced as the protective group, it is preferred to introduce the acyl group to the oxygen atom of the phenolic hydroxyl group in the lignophenol derivative. Specifically, the acyl group can be introduced to the hydroxyl group by reaction with an acylating agent such as a carboxylic acid, a carboxylic acid anhydride, a mixed acid anhydride or an acid halide. It is also possible to use a base upon reaction with the acylating agent.

As the acyl group, there can be illustrated an acetyl group, a propionyl group, a butyryl group, a valeryl group, a benzoyl group and a toluoyl group, with an acetyl group being preferred.

Protection of the hydroxyl groups serves to reduce association properties as a result of, for example, reduction in number of hydrogen bonds, or it is possible to impart new properties by the introduced protective group.

This acyl group-introducing reaction can be performed by properly applying the conditions for general acyl group-introducing reactions to the lignophenol derivatives.

In the case of introducing a group having a carboxyl group as a protective group, it is preferred to introduce the carboxyl group simultaneously with esterification of the phenolic hydroxyl groups in the lignophenol derivatives using an acid di- (or more) halide.

As the carboxylic dihalide, for example, adipic acid dichloride, maleic acid dichloride and terephthalic acid dichloride can be used. Esterification reactions using these carboxylic acid dihalides are well known to those skilled in the art and can be performed by properly applying general reaction conditions to the lignophenol derivatives.

Also, in the case where a group having a carboxyl group is introduced as a protective group, it is also possible to introduce the group in the state wherein the carboxyl group is protected with a protective group to the phenolic hydroxyl groups in the lignophenol derivatives and then remove the protective group. As the protective group for the carboxyl group, commonly known protective groups can be used.

In the case where a group having an amido group is introduced as a protective group, it is preferred to introduce the amido group simultaneously with esterification of the phenolic hydroxyl groups in the lignophenol derivatives using an carboxylic acid halide having an amido group or to introduce the aforesaid group having a carboxyl group as a protective group and subsequently convert the carboxyl group to the amido group.

As R and R' in the aforesaid amido group (—CONRR'), there can be illustrated, independently, a hydrogen atom, a lower straight or branched alkyl group containing from 1 to 5 carbon atoms, a cycloalkyl group optionally having a substituent containing from 6 to 9 carbon atoms, an alkylaryl group and an aralkyl group.

Regarding the reaction of introducing the group having an amido group, conventionally known various reagents and conditions can properly be selected to employ.

The reaction of introducing a substituent to an aromatic ring is preferably performed by, for example, reacting under an alkaline condition the lignophenol derivative with a compound capable of forming a cross-linkable group to thereby introduce the cross-linkable group to the lignophenol derivative at the o- and/or p-position of the phenolic hydroxyl group thereof.

This reaction can be performed by mixing the lignophenol derivative with the compound capable of forming a cross-linkable group under the state wherein the phenolic hydroxyl groups of the lignophenol derivative can dissociate. The state wherein the phenolic hydroxyl groups of the lignophenol derivative can dissociate is usually established in an appropriate alkali solution. Kind and concentration of the alkali to be used and kind of the solvent to be used are not particularly limited as long as the phenolic hydroxyl groups of the lignophenol derivative can dissociate and, for example, a 0.1N sodium hydroxide aqueous solution can be used.

Under such condition, the cross-linkable group is introduced to the o- or p-position of the phenolic hydroxyl group, and hence the position to which the cross-linkable group is introduced is approximately determined by kind and combination of the phenol compounds to be used. That is, in the case where substituents exist at two of the o- and the p-positions, the cross-linkable group is not introduced to the aromatic ring of the introduced phenol compound, but is introduced to the phenolic aromatic ring of the mother lignin. Since phenolic aromatic rings of the mother lignin exist mainly at the terminal ends of the polymer of lignophenol derivative, prepolymers wherein the cross-linkable groups are introduced mainly to the terminal ends of the polymer are obtained.

Also, in the case where one or less substituent exists at the o- and the p-positions, the cross-linkable group is to be introduced into the aromatic ring of the introduced phenol compound and the phenolic romatic ring of the mother lignin. Therefore, the cross-linkable group is introduced not only to the terminal ends of the polymer chain but also to the main chain thereof, thus multi-functional prepolymers being obtained.

Kind of the cross-linkable group to be introduced into the lignophenol derivative is not particularly limited. Those which can be introduced to the aromatic rings of the mother lignin or to the aromatic ring of the introduced phenol compound are preferred.

As the cross-linkable group, there can be illustrated a hydroxymethyl group, a hydroxyethyl group, a hydroxypropyl group, and a 1-hydroxyvaleraldehyde group.

The compounds capable of forming the cross-linkable group are nucleophilic compounds and are compounds which form or retain the cross-linkable group after forming a bond. For example, there can be illustrated formaldehyde, acetaldehyde, propionaldehyde and glutaraldehyde. In consideration of introduction efficiency, it is preferred to use formaldehyde.

Upon mixing the lignophenol derivative with the compound capable of forming the cross-linkable group, the compound capable of forming the cross-linkable group is added, from the standpoint of effectively introducing the cross-linkable group, in an amount of preferably 1 mol or more, more preferably 10 mols or more, still more preferably 20 mols or more, per mol of the aromatic ring of arylpropane units of lignin in the lignophenol derivative and the aromatic ring of the introduced phenol compound.

Next, this mixture is, as needed, heated in the state of an alkali solution wherein the lignophenol derivative and the compound capable of forming the cross-linkable group exist to thereby introduce the cross-linkable group to the phenol ring of the phenol compound. Heating conditions are not particularly limited as long as the cross-linkable group is introduced, and is preferably from 40° C. to 100° C., more preferably from 50° C. to 80° C., particularly preferably 60° C. The reaction is discontinued by, for example, cooling the reaction solution, and the reaction solution is acidified (to about pH2) with an appropriate concentration of hydrochloric acid or the like, and then the acid and the unreacted compound capable of forming the cross-linkable group are removed by washing, dialysis or the like. After dialysis, a sample is recovered by lyophilization. Drying under reduced pressure is performed, as needed, by using diphosphorus pentoxide.

The thus-obtained cross-linkable second-order derivative has a cross-linkable group at the o- and/or the p-position with respect to the phenolic hydroxyl group in the lignophenol derivative.

Also, the amount of introduced cross-linkable group is preferably from 0.01 mol/(C9 units of lignin) to 1.5 mols/(C9 units of lignin).

The alkali-treating reaction of the lignophenol derivative is performed by bringing the lignophenol derivative into contact with an alkali and, preferably, under heating.

For example, in the case where, in the structure of the lignophenol derivative, the introduced phenol compound forms an o-position-bound unit which forms a bond between the o-position of the phenolic hydroxyl group of the introduced phenol compound and the side-chain α-position of the phenylpropane unit of the lignin with an aryl ether bond being formed between the side-chain β-position of the phenylpropane unit and other propane unit, the alkali treatment causes intramolecular nucleophilic substitution reaction of the phenoxide ion of the introduced phenol compound toward the carbon atom at the side-chain β-position, thus the aryl ether bond being cleaved to produce products having a smaller molecular weight. Such change serves to impart to the second-order derivative light-absorbing properties different from that of the lignophenol derivative.

Specifically, the alkali treatment is performed by dissolving the cross-linked body of the lignophenol derivative in an alkali solution to react for a predetermined period of time and, as needed, heating the mixture. The alkali solution which can be used in this treatment may be any alkali solution that can dissociate the phenolic hydroxyl group of the introduced phenol compound in the lignophenol derivative, and kind and concentration of alkali and kind of solvent are not particularly limited. Because, as long as dissociation of the phenolic hydroxyl group occurs under the alkaline condition, a coumaran (2,3-dihydrobenzofuran) structure is formed due to the neighboring group participation effect. For example, lignophenol derivatives to which p-cresol has been introduced permit to use a sodium hydroxide solution. For example, the alkali concentration of the alkali solution is in the range of preferably from 0.5 N to 2 N, and the treating period is in the range of preferably from 1 hour to 5 hours. Also, when heated, the lignophenol derivative in the alkali solution readily forms the coumaran structure. Conditions such as temperature and pressure to be employed upon heating can be determined with no particular limitations. For example, reduction in molecular weight of the cross-linked body of the lignophenol derivative can be achieved by, for example, heating the alkali solution to a temperature of 100° C. or higher (for example, about 140° C.). Further, it is also possible to reduce the molecular weight of the cross-linked body of the lignophenol derivative by heating the alkali solution to a temperature higher than the boiling point thereof under pressure.

Additionally, it has been known that, when the alkali concentration is at the same level, a higher heating temperature more accelerates reduction in molecular weight due to cleavage of the aryl ether bond at the side-chain β-position as long as the heating temperature is in the range of from 120° C. to 140° C. It has also been known that, in the above-mentioned temperature range, a higher heating temperature increases the number of the phenolic hydroxyl group derived from the aromatic ring derived from the mother lignin and decreases the number of the phenolic hydroxyl group derived from the introduced phenol derivative. Therefore, degree of reduction in molecular weight and degree of shift of the phenolic hydroxyl group position from the introduced phenol derivative side at the side-chain α-position to the phenol nucleus of the mother lignin can be adjusted by properly determining the reaction temperature. That is, in order to accelerate reduction in molecular weight or to obtain an arylcoumaran derivative wherein more phenolic hydroxyl group positions are shifted from the introduced phenol derivative side at the side-chain α-position to the mother lignin, the reaction temperature is preferably from 80° C. to 140° C.

As has been described hereinbefore, cleavage of the aryl ether at the side-chain β-position in the o-position-bound unit due to neighboring group participation of the phenol nucleus at the side-chain α-position is accompanied by formation of the arylcoumaran structure. However, reduction in molecular weight of the cross-linked body of the lignophenol derivative is not necessarily performed under the conditions under which the arylcoumaran structure is effectively produced (at approximately 140° C.), and can be performed at a higher temperature (for example, approximately 170° C.) depending upon kind of the material or upon the end purpose. In this case, the once formed couraman ring is opened, and the phenolic hydroxyl group is regenerated on the introduced phenol derivative side and, further, a conjugation system is newly formed by change in the molecular structure accompanying transfer of the aryl group, thus light-absorbing properties different from that of the lignophenol derivative and that of the second-order derivative having the aforesaid arylcouraman structure being obtained. The heating temperature in the alkali treatment is not particularly limited, but the alkali treatment is preferably performed at a temperature of from 80° C. to 200° C.

As one preferred example of the treatment for forming the coumaran structure and accompanying reduction in molecular weight, there can be illustrated the conditions of using a 0.5 N sodium hydroxide aqueous solution as the alkali solution and heating in an autoclave at 140° C. for 60 minutes. In particular, the conditions can preferably be applied to lignophenol derivatives having been prepared by using p-cresol or 2,4-dimethylphenol. Also, as one example of the alkali treatment which is accompanied by formation of a new conjugation system, there can be illustrated the conditions of using a 0.5 N sodium hydroxide aqueous solution as the alkali solution and heating in an autoclave at 170° C. for 20 minutes to 60 minutes.

The second-order derivatives of the lignophenol derivatives, which can be used in the invention, are preferably those second-order derivatives which are obtained by subjecting the lignophenol derivatives to a reaction of introducing an acetyl group, a carboxyl group, an amido group or a cross-linkable group or to the alkali-treating reaction.

Various second-order derivatives can be obtained by these treatments for producing the derivatives. Further, these second-order derivatives can further be subjected to the above-mentioned individual treatments (preferably different kinds of treatments) to produce higher-order derivatives.

In this case, there can be obtained higher-order derivatives which have a combination of the structural characteristic properties generated by the performed treatments. For example, a combination of the alkali treatment and the reaction of introducing the cross-linkable group, a combination of the alkali treatment and the treatment of protecting hydroxyl group such as the reaction of introducing an acyl group, or a combination of the reaction of introducing the cross-linkable group and the reaction of introducing an acyl group can be employed.

As the lignophenol derivatives which can be used in the invention, the higher-order derivatives obtained by subjecting the lignophenol derivatives to two or more kinds of the reactions selected from the group consisting of the reaction of introducing an acetyl group, a carboxyl group, an amido group or a cross-linkable group and the alkali-treating reaction are preferred.

The lignophenolo derivatives which can be used in the invention also include cross-linked bodies obtained by cross-linking through heat or the like the second-order cross-linkable body or the higher-order cross-linkable body of the lignophenol derivative to which the cross-linkable group has been introduced. The cross-linked bodies are preferably generated by cross-linking through heat.

Various lignophenol derivatives may be exposed to irradiation with various energies such as heat, light, radiation, etc. One of these energy irradiations accelerates polymerization of the lignohenol derivatives, and the conjugation system thus formed can expand the light absorption region or increase the absorption intensity. The energy irradiation is not particularly limited, and one of, or a combination of two or more of, heat rays, various light rays, radiation and electron beams can be employed. These energy irradiations are performed in the process of separation or extraction of the lignin derivatives or in the process of circulatory use thereof. Increase of the conjugation system may not be particularly intended.

Also, in addition to the above descriptions, more general descriptions on the lignophenol derivatives and on the production processes thereof are given in JP-A-2-233701, JP-A-9-278904, WO99/14223, JP-A-2001-64494, JP-A-2001-261839, JP-A-2001-131201, JP-A-2001-34233 and JP-A-2002-105240. (All of the contents of these patent documents are hereby incorporated by reference.)

The lignophenol derivatives which can be used in the invention are preferably produced by using a micro-reactor.

In the case of producing the lignophenol derivative by using the micro-reactor, condensation of lignin which can be caused by local contact between lignin and the acid upon stirring and mixing of the solution prepared by solvating lignin with the phenol derivative and the acid can be prevented, thus the yield of the lignophenol derivative being improved and the resulting product having a stable, even quality with respect to molecular weight distribution or the like. In particular, reduction in the yield and uneven quality can be avoided upon scale-up of the reaction.

Further, use of the micro-reactor permits accurate temperature control, and hence condensation of lignin due to heat of reaction upon addition of the concentrated acid, thus production of lignophenol derivatives having a stable quality becoming possible.

In order to accelerate dissolution of the cellulose component, facilitate extraction of the lignophenol derivative and improve the yield, it is preferred for the micro-passages in the micro-reactor to have commonly units for applying thereto electromagnetic waves such as ultrasonic waves and microwaves, micro-vibration by a piezoelectric element such as a piezo element, or energy such as electric field.

The lignophenol derivatives which can be used in the invention are more preferably those which are produced by a process for producing the lignophenol derivative, which process includes the step of preparing a micro-reactor having the first and the second micro-passages and the confluence passage where the fluid from the first micro-passage and the fluid from the second micro-passage join, and the step of respectively feeding the first fluid of lignin having been solvated with the phenol derivative and the second fluid containing the acid to the micro-reactor and performing the reaction in the aforementioned confluence passage to obtain the lignophenol derivative.

The micro-reactor in the invention is a small-sized tridimensional structure to be used for performing a chemical reaction. The micro-reactor is in some cases called a micro-channel reactor, and the one for mixing is in some cases called a micro-mixer.

Such reactors have attracted attention in recent years and are described in detail in, for example, *Microreactors New Technology for Modern Chemistry* (written by Wolfgang Ehrfeld, Volker Hessel and Holger Loewe; published by WILEY-VHC in year 2000).

In the micro-reactor, the reaction can be performed in a micro-space, and hence synthesis on a micro scale is possible, and the temperature can be accurately controlled. Further, the micro-reactor has an extremely large surface area per unit volume and a small Reynolds' number, and hence the micro-reactor has the characteristic that a laminar flow can easily be formed.

FIG. 1 schematically shows the structure of one example of a reaction apparatus having the micro-reactor to be preferably used for the process for producing the lignophenol derivative.

The reaction apparatus 10 shown in FIG. 1 is equipped with the first flow passage L1 for passing the first fluid 16 of lignin having been solvated with the phenol derivative, the flow passage L2 for passing the second fluid 18 containing the acid, and the flow passage L3 which is connected to each end of the flow passages L1 and L2 and wherein the first fluid 16 and the second fluid 18 join to generate a laminar flow. A micro-syringe 20 retaining the first fluid 16 is connected to the upstream end of the flow passage L1, and a micro-syringe 22 retaining the second fluid 18 is connected to the upstream end of the flow passage L2.

Regarding the mixing ratio of the lignocellulose material contained in the first fluid 16 to the phenol derivative, the amount of the phenol derivative is preferably from 5 to 100 parts by weight, more preferably from 7 to 50 parts by weight, per part by weight of the lignocellulose material. When the mixing ratio of the lignocellulose material to the phenol derivative is within the above-described range, the phenol derivative sufficiently permeates into the lignocellulose material, the viscosity of the resulting mixture does not increase too high, and the decomposition reaction of the cellulose component proceeds with ease.

On the other hand, to the second fluid 18 containing the acid may be added an inert low-boiling hydrophobic organic solvent such as benzene, xylene, toluene, hexane or the mixture thereof in addition to the above-mentioned acid.

The flow passages (channels) in the micro-reactor 12 are of microscale size. That is, the widths of the flow passages in the micro-reactor 12 are 2,000 μm or less, preferably from 10 to 2,000 μm, more preferably from 30 to 1,500 μm. Therefore, in the micro-reactor, both the flow amount and the flow rate of the fluid are so small that the Reynolds' number becomes as small as 200 or less.

Also, as is shown in FIG. 1, the first fluid 16 of lignin having been solvated with the phenol derivative and retained in the microsyringe 20 and the second fluid 18 containing the acid and being retained in the microsyringe 22 are pumped to the flow passages L1 and L2, respectively, by means of fluid-feeding pumps P1 and P2 and fed to the micro-reactor 12 through filters F1 and F2 and are reacted in the micro-reactor 12 to produce a mixed solution 28 containing the lignophenol derivative. Additionally, here, the filters F1 and F2 may be omitted.

Also, the first fluid 16 and the second fluid 18 are fed to the micro-reactor 12 preferably in such manner that the following condition is satisfied:

$$1 \leqq (V_2/V_1) \leqq 10 \quad (1)$$

wherein $V_1$ represents the rate of feeding the first fluid 16, and $V_2$ represents the rate of feeding the second fluid 18.

When $V_2/V_1$ is within the above-described range, decomposition reaction of the cellulose component readily occurs, and condensation of lignin due to contact between lignin and the acid scarcely occurs.

The micro-reactor 12 is equipped with a heating and cooling device 14, and the temperature thereof is controlled by means of a temperature-controlling device 24. It is also possible to install the heating and cooling device within the reactor. Further, in order to control the temperature, the whole reactor may be placed in a temperature-controlled vessel.

Still further, in the invention, an ultrasonic wave oscillator which conducts ultrasonic wave oscillation, a piezoelectric element which generates pulse-like pressure, and a unit for applying microwaves, magnetic field or electric field may be provided in addition to the temperature-controlling device 24.

Also, as a mixing unit employed in micro-reactors, there can be illustrated various ones as is described in the foregoing *Microreactors New Technology for Modern Chemistry*, pp. 43-46 and JP-A-2004-33901.

Figure 2:
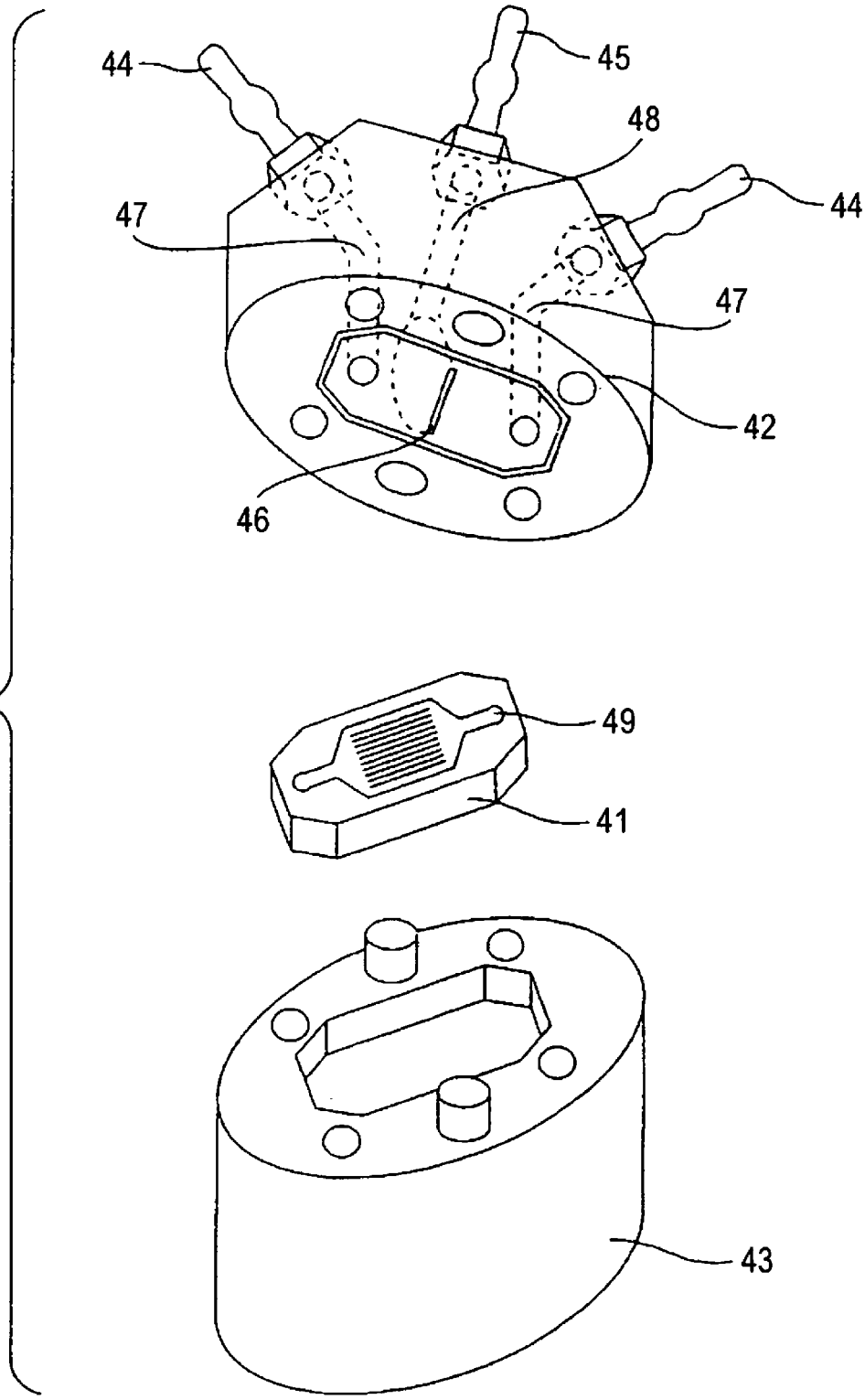
FIG. 2 is a view showing one example of the micro-reactor in a decomposed state, wherein the upper part 42 of the micro-reactor is viewed from the bottom, and the mixing element 41 and the lower part 43 of the micro-reactor are viewed from above.

FIG. 2 describes the micro-reactor manufactured by Institut fur Mikrotechnik Mainz GmbH. This micro-reactor employs one of the mixing methods described in JP-A-2004-33901 and can be preferably used in the invention.

The micro-reactor shown in FIG. 2 includes a mixing element 41, an upper part 42 of the micro-reactor, and a lower part 43 of the micro-reactor. In FIG. 2, these parts are shown in an exploded manner but, in actual use, these are assembled and unified to use.

Figure 3:
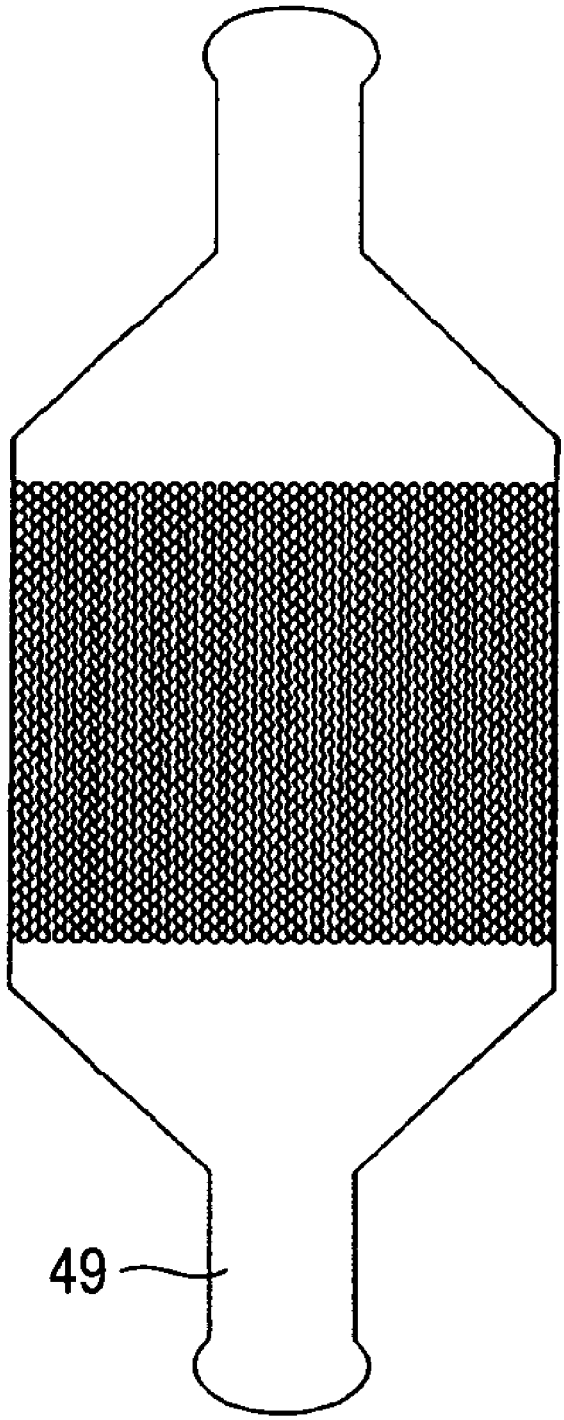
FIG. 3 is a view showing one example of the mixing element of the micro-reactor.

The mixing element 41 in FIG. 2 has on the surface thereof flow passages divided by fine processing. One example of the mixing element 41 is shown in FIG. 3. In the mixing element of FIG. 3, divided flow passages are formed from both sides of the mixing element by grooves of the shape shown in FIG. 3. A number of sub-flows are obtained by introducing thereinto solutions to be used for the reaction.

From the standpoint of mixing, the width of each of the divided flow passages is preferably 100 μm or less, more preferably 50 μm or less. The lower limit of the width is not particularly limited but, in view of production restrictions, it is of the order of several μm. Also, the depth of the flow passage is not particularly limited, and can be, for example, from 10 to 500 μm.

The divided flow passages of the mixing element 41 can be formed by applying the fine processing technology employed in the electronics field. Methods for forming the flow passages are not particularly limited and, for example, there can be illustrated a method of employing the technique called soft lithography using a silicone rubber as a material, and a method of wet etching applying fluoric acid to a material of glass.

The upper part 42 of the reactor in FIG. 2 has two inlets 44 and one outlet 45. The inlet 44 leads to the inlet flow passage 47, and the terminal end of the inlet flow passage 47 is connected to the end 49 of the flow passages of the mixing element. Also, the outlet 45 leads to the outlet flow passage 48, and the terminal end of the outlet flow passage 48 forms the slit 46 provided at the approximately central position of the upper part of the reactor. In the case of assembling the micro-reactor, the slit 46 comes into contact with the approximate center of the mixing element 41, whereby a flow passage is formed which connects the flow passages on the mixing element 41 to the slit 46.

The lower part 43 of the micro-reactor has a depression for fixing the mixing element 41. Divided flow passages are formed with no gaps by fixing the mixing element in the depression, and the reaction can be performed smoothly.

When the mixing element 41, the upper part 42 of the micro-reactor and the lower part 43 of the micro-reactor are assembled, there is formed a flow passage wherein the inlet 44, inlet flow passage 47, end 49 of flow passage of the mixing element, divided flow passages on the mixing element 41, slit 46, outlet flow passage 48, and outlet 45 are connected, in order, to each other.

Additionally, there exists a micro space for mixing between the mixing element 41 and the slit 46.

In the case of performing the reaction in the micro-reactor shown in FIG. 2, the reaction can be performed in the following manner. First, the aforementioned first fluid and second fluid are introduced through respective inlets 44 in such a manner that the condition of the rate of feeding represented by above (1) is satisfied. As the micro-reactor used in this case, a device of highly acid-resistant material such as hastelloy is used. Additionally, it suffices for the high-molecular, pigment-dispersing agent to be contained in either or both of the metal compound solution and the reductive compound solution. Introduction of the solutions is performed preferably under a definite pressure using a pump. When pulsation occurs in the introduction, the metal generated by the reaction can precipitate in the fine flow passages to cause clogging and inhibit continuous reaction. Therefore, it is preferred to use pumps which do not cause pulsation, such as a syringe pump and a pump to be used for high pressure liquid chromatography.

The solutions introduced through the inlet 44 are fed to the ends 49 of the flow passage of the mixing element through the inlet flow passages 47. The solutions respectively fed to the ends 49 of the flow passage of the mixing element flow from both ends of the mixing element toward the center through the divided flow passages on the mixing element 41 by the introducing pressure and, as a result, a number of sub-flows are obtained. A number of the sub-flows contact with each other in the micro space existing between the mixing element 41 and the slit 46, thus the reaction proceeding. Since the reaction occurs in the micro space, it is easy to control the conditions such as reaction temperature and, since a number of the sub-flows contact with each other almost simultaneously, the starting materials are fully mixed without stirring, thus energy efficiency being good. In addition, since the reaction is performed by continuing introduction of the starting solutions at a definite rate, the reaction is performed in a continuous manner, and it is easy to keep constant the reaction conditions.

The volume of the micro space where the reaction occurs can be, for example, of a micro-liter order of 10 μL, though not being particularly limited.

The two solutions having contacted with each other in the micro space in turn flow into the slit 46. Mixing of the two solutions further proceeds upon the solutions being introduced into the slit. In consideration of efficiency of mixing, the width of the slit is preferably 500 μm or less.

The rate of introducing each solution to be reacted is preferably from 10 mL/hr to 1.5 L/hr, more preferably from 10 mL to 1.5 L/hr, though depending upon the inside volume of the slit. When the flow rate is 10 mL/hr or more, the reaction rate becomes so large that the reaction can be effectively performed, and no solids precipitate and the solutions are not inhibited to flow.

When the flow rate is 1.5 L/hr or less, the flow rate can easily be controlled at a definite level, which serves not to apply high pressure to the micro-reactor.

The reaction solution having passed through the slit 46 is discharged out of the micro-reactor via the outlet passage 48 through the outlet 45.

The micro-reactor which can be used in the invention is not particularly limited as long as it permits production of the lignophenol derivative and, besides the above-described one, commonly known ones such as micro-reactors which are described in publications of Institut fur Mikrotechnik Mainz GmbH, Germany, a collision type micro-reactor described in JP-A-2005-288254, a micro-reactor described in JP-A-2005-37780 and a micro-reactor described in JP-A-2004-33901 can preferably be utilized.

Also, as micro-reactors which can be used in the invention, the collision type micro-reactor described in JP-A-2005-288254 can preferably be used. The collision type micro-reactor is briefly described hereinafter and, as to details thereof, reference can be made to JP-A-2005-288254.

As the collision type micro-reactor which can be used in the invention, a micro-reactor is also preferred wherein the central axis of at least one feeding channel and the central axis of at least one sub-channel feeding at least one different kind of fluid cross each other at one point, or wherein at least two axes of sub-channels respectively feeding different fluids cross each other at one point.

The central axis of each of the feeding channels or of the sub-channels means an axis (or straight line) along the locus formed by moving the weight center of fluid flowing into the confluence region through the feeding channel or sub-channel, that is, the weight center (or the center of gravity) of the fluid existing in the feeding channel or sub-channel in the position adjacent to the confluence region. The term "cross each other at one point" as used herein means that, when number of the central axes to be considered is two, they cross each other at one point and, when number of the central axes to be considered exceeds 2, all of such central axes cross each other at one point.

The sub-channels are flow passages for transporting the fluid stream fed to the micro-reactor in the form of plural divided sub-streams and, similarly to the above-mentioned feeding channels, are not particularly limited as long as they feed fluids fed to the micro-reactor to the confluence region and are usually conduits having a circular or rectangular cross-section. In general, the thickness of the sub-channels are the same as, or smaller than, that of the feeding channels.

Specifically, in the case where two fluids join, in one embodiment, one fluid is fed to the confluence region through the sub-channels, and the other fluid is fed thereto through the feeding channel, and the axis of one or more, most preferably all, sub-channels crosses the axis of the feeding channel at one point. In another embodiment, two fluids are fed to the confluence region through sub-channels, and the axis of one or more, most preferably all, sub-channels for one fluid crosses the axis of one or more, most preferably all, sub-channels for the other fluid at one point.

In the case where three or more kinds of fluids are fed, too, at least one of them, more preferably two of them, most preferably three of them, are fed through the sub-channels. And, the axis of at least one or more of the sub-channels for at least one kind of fluid crosses the axis of at least one or more of channels and sub-channels for other two or less fluid at one point. Most preferably, all axes cross each other at one point.

2. Phthalocyanine Pigments

The photo-sensitive layer in the electrophotographic photoreceptor of the invention contains a phthalocyanine pigment as a charge-generating substance.

The phthaloocyanine pigment is not particularly limited and, for example, there can be illustrated metal-free phthalocyanine pigments, titanyl phthalocyanine pigments, copper phthalocyanine pigments, chlorogallium phthalocyanine pigments, hydroxygallium phthalocyanine pigments, vanadyl phthalocyanine pigments, chloroindium phthalocyanine pigments, and dichlorotin phthalocyanine pigments.

The phthalocyanine pigments which can be used in the invention are preferably metal-free phthalocyanine pigments, titanyl phthalocyanine pigments, chlorogallium phthalocyanine pigments or hydroxygallium phthalocyanine pigments and, in view of sensitivity and environmental stability, hydroxygallium phthalocyanine pigments are more preferred.

Figure 4:
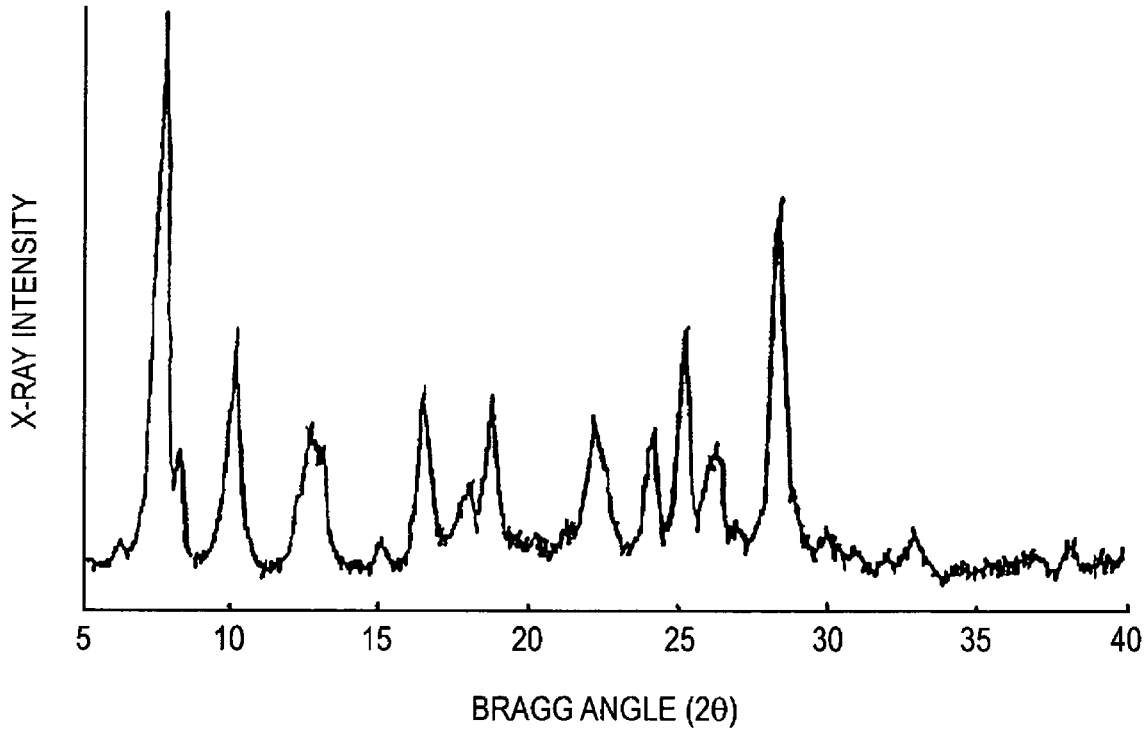
FIG. 4 is a powder X-ray diffraction chart of one example of hydroxygallium phthalocyanine crystals which can be used in the invention.

Of the hydroxygallium phthalocyanine pigments, the hydroxygallium phthalocyanine pigments which have intense diffraction peaks at Bragg angles (2θ±0.2°) of 7.5°, 9.9°, 12.5°, 16.3°, 18.6°, 22.1°, 24.1°, 25.1° and 28.3° for CuKαcharacteristic X rays as shown in FIG. 4 are particularly preferred.

The hydroxygallium phthalocyanine pigments of the above-mentioned crystal form are prepared by heat-condensing 1,3-diisoiminoindoline and gallium trichloride in a solvent, dissolving the resulting chlorogallium phthalocyanine with an acid such as sulfuric acid or trifluoroacetic acid, re-precipitating in an alkaline aqueous solution such as aqueous ammonia or an aqueous solution of sodium hydroxide or in cold water to perform acid pasting (preparation of I type hydroxygallium phthalocyanine), and then treating with a solvent using an organic solvent such as an amide (e.g., N,N-dimethylformamide, N,N-dimethylacetamide or N-methylpyrrolidone), an ester (e.g., ethyl acetate, n-butyl acetate or i-amyl acetate), a ketone (e.g., acetone, methyl ethyl ketone or cyclohexanone) or dimethylsulfoxide to convert crystal form thereof.

Of the hydroxygallium phthalocyanine pigments, those hydroxygallium phthalocyanine pigments can most preferably be used which have a maximum peak of from 810 nm to 839 nm in the range of from 600 nm to 900 nm in the absorption spectrum, since they do not contain coarse particles and have fine properties with pigment particle size. Such hydroxygallium phthalocyanine pigments can be obtained by subjecting the I type hydroxygallium phthalocyanine obtained by the foregoing acid pasting treatment to a wet pulverizing treatment together with a solvent to convert crystal form thereof.

In the process for producing the hydroxygallium phthalocyanine pigments, a pulverizing apparatus is preferred in the wet pulverizing treatment in which spherical media of from 0.1 mm to 3.0 mm in outer diameter are used. Use of spherical media of from 0.2 mm to 2.5 mm is particularly preferred. When the outer diameter of the media is in the above-mentioned range, there can be obtained such a high pulverizing efficiency that a desired particle size can easily be obtained and, in addition, separation of the media from the hydroxygallium phthalocyanine pigment can be performed with ease. Further, spherical media are preferred because they have a high pulverizing efficiency and generate no worn powder thereof.

As to materials for the media, any materials can be used, and those which scarcely cause image defects even when contaminating into the pigments are preferred. Glass, zirconia, alumina, and agate can preferably be used.

As to materials for the vessel, any materials can be used, and those which scarcely cause image defects even when contaminating into the pigments are preferred. Glass, zirconia, alumina, agate, polypropylene, Teflon (trade name) (E.I. du Pont de Nemours & Co. Inc.), and polyphenylene sulfide can preferably be used. It is also possible to line the inside of a vessel of metal such as iron or stainless steel with glass, polypropylene, Teflon (trade name) or polyphenylene sulfide.

The amount of media to be used varies depending upon apparatuses to be used, and is preferably 50 parts by weight or more, more preferably from 55 parts by weight to 100 parts by weight per part by weight of I type hydroxygallium phthalocyanine. Also, as the outer diameter of the media becomes smaller, the density of media inside the apparatus increases, and the density of the mixed solution increases, thus pulverizing efficiency being changed. Therefore, as the outer diameter of the media becomes smaller, it is desirable to perform the wet treatment with an optimal mixing ratio by properly controlling the amount of media used and the amount of solvent used.

Also, the temperature of the wet pulverizing treatment is preferably from 0° C. to 100° C., more preferably from 5° C. to 80° C., still more preferably from 10° C. to 50° C. When the temperature is within the above-described range, the rate of conversion of crystal form can be maintained at an appropriate level, and the size of the pigment can be easily adjusted to an appropriate particle size.

As solvents to be used for the wet pulverizing treatment, the aforesaid organic solvents can be used. The amount of the solvent to be used is preferably from 1 part by weight to 200 parts by weight, more preferably from 1 part by weight to 100 parts by weight, per part by weight of the hydroxygallium phthalocyanine pigment.

As an apparatus to be used for the wet pulverizing treatment, there can be used those apparatuses wherein media are used as dispersing media, such as a vibration mill, an automated mortar, a sand mill, a Dyno mill, a CoBall mill, an attritor, a planetary ball mill, and a ball mill.

The progress speed of the conversion of crystal form is largely influenced by the scale of the wet pulverizing treatment step, stirring speed, kind of media material, etc. The wet pulverizing treatment is continued till hydroxygallium phthalocyanine is converted to the predetermined crystal form which has a maximum peak of from 810 nm to 839 nm in the range of from 600 nm to 900 nm in the absorption spectrum of the hydroxygallium phthalocyanine with monitoring the state of crystal form conversion through measurement of absorption wavelength of the solution under wet pulverizing treatment. The time of the wet pulverizing treatment is in the range of preferably from 5 hours to 500 hours, more preferably from 7 hours to 300 hours. When the time is within the above-described range, conversion of the crystal form is fully completed, an excellent sensitivity is obtained with high productivity, and problems such as contamination with worn powder of the media do not occur. The thus-determined time of the wet pulverizing treatment enables one to complete the wet pulverizing treatment in such state that hydroxygallium phthalocyanine particles are pulverized into uniform particles. Thus, it becomes possible to suppress unevenness in quality between lots in the case of repeatedly performing the wet pulverizing treatment for a plurality of lots.

3. Layer Structure of Electrophotographic Photoreceptor

The electrophotographic receptor of the invention has at least a photosensitive layer on a conductive substrate. Additionally, the term "on" a conductive substrate means to be positioned on or above the substrate. That is, the photosensitive layer is not necessarily provided in contact with the conductive support, and may be provided either in contact with the conductive layer, or other layer may be provided between the conductive substrate and the photosensitive layer.

Preferred exemplary embodiments of the invention will be described hereinafter by reference to drawings, but the layer structure of the electrophotographic photoreceptor of the invention is not limited only to them. Additionally, the same reference numerals and signs are imparted to the same or corresponding parts, and repeated descriptions are omitted.

(1) FIRST EXEMPLARY EMBODIMENT

Figure 5:
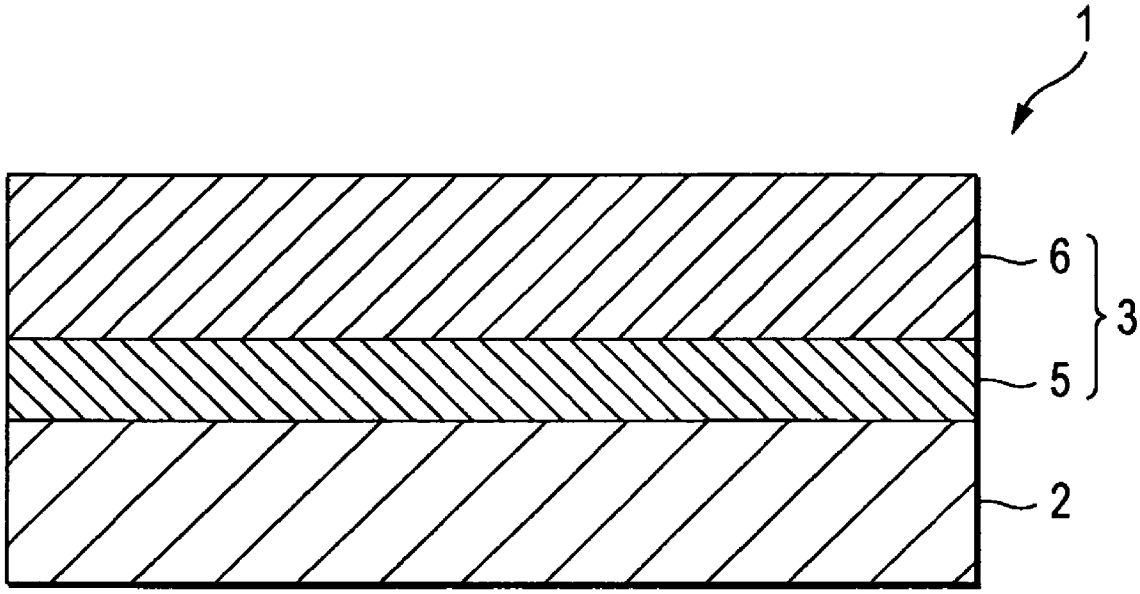
FIG. 5 is a cross-sectional view showing the first exemplary embodiment of the electrophotographic photoreceptor of the invention.

FIG. 5. is a cross-sectional view showing the first exemplary embodiment of the electrophotographic photoreceptor of the invention.

As is shown in FIG. 5, the electrophotographic photoreceptor 1 is constituted by a conductive substrate 2 and a photosensitive layer 3 constituted by a charge-generating layer 5 and a charge-transporting layer 6. This photosensitive layer 3 contains the lignophenol derivative, and the charge-generating layer 5 constituting the photosensitive layer 3 contains the phthalocyanine pigment as a charge-generating substance.

(2) SECOND EXEMPLARY EMBODIMENT

Figure 6:
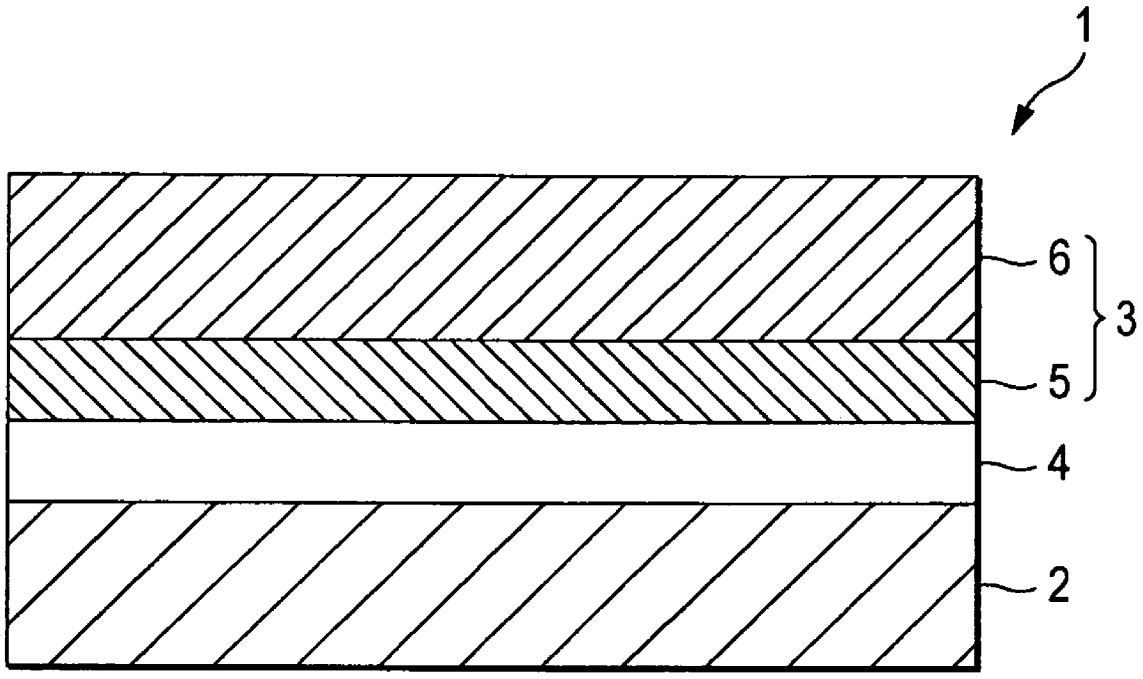
FIG. 6 is a cross-sectional view showing the second exemplary embodiment of the electrophotographic photoreceptor of the invention.

FIG. 6. is a cross-sectional view showing the second exemplary embodiment of the electrophotographic photoreceptor of the invention.

As is shown in FIG. 6, the electrophotographic photoreceptor 1 is constituted by a conductive substrate 2, an undercoat layer 4, and a photosensitive layer 3 constituted by a charge-generating layer 5 and a charge-transporting layer 6. This undercoat layer 4 is a layer which contains at least metal oxide particles and a binder.

(3) THIRD EXEMPLARY EMBODIMENT

Figure 7:
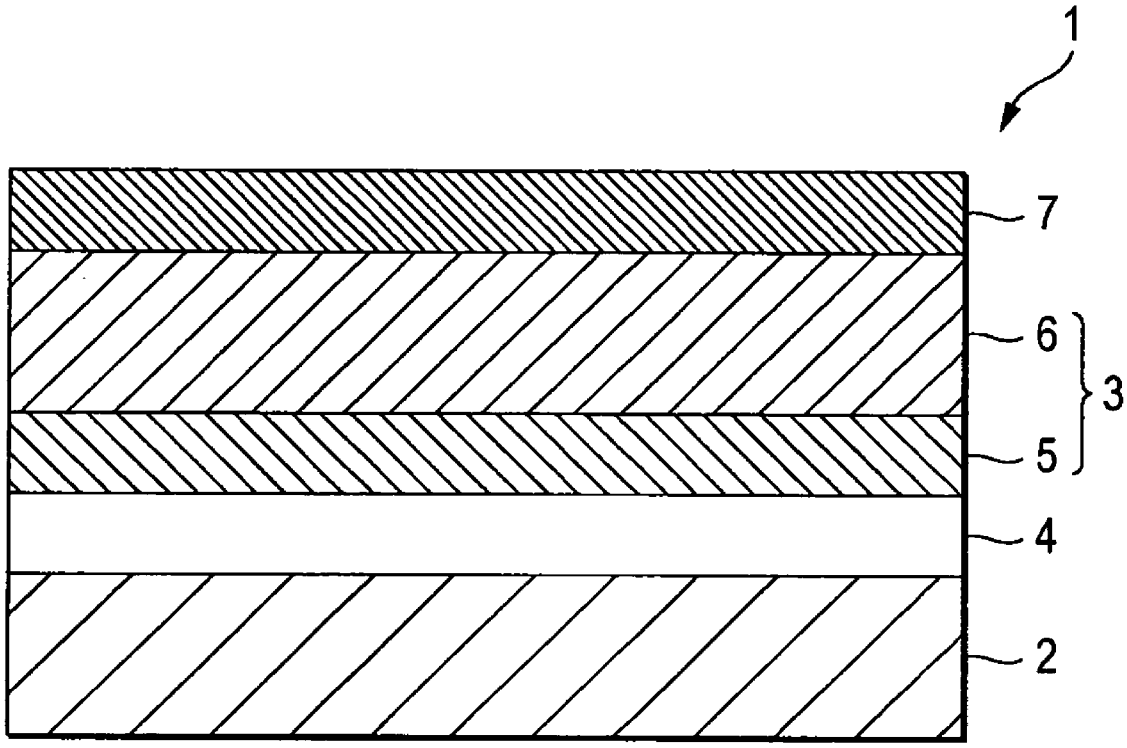
FIG. 7 is a cross-sectional view showing the third exemplary embodiment of the electrophotographic photoreceptor of the invention.

FIG. 7. is a cross-sectional view showing the third exemplary embodiment of the electrophotographic photoreceptor of the invention.

As is shown in FIG. 7, the electrophotographic photoreceptor 1 has the same constitution as that of the electrophotographic photoreceptor 1 shown in FIG. 6 except for providing a protective layer 7 on the photosensitive layer 3. The protective layer 7 is used for preventing chemical change of the charge-transporting layer 6 upon charging the electrophotographic photoreceptor 1 and for more improving mechanical strength of the photosensitive layer 3. This protective layer 7 can be formed by coating on the photosensitive layer 3 a coating solution containing a conductive substance in an appropriate binder.

(4) FOURTH EXEMPLARY EMBODIMENT

Figure 8:
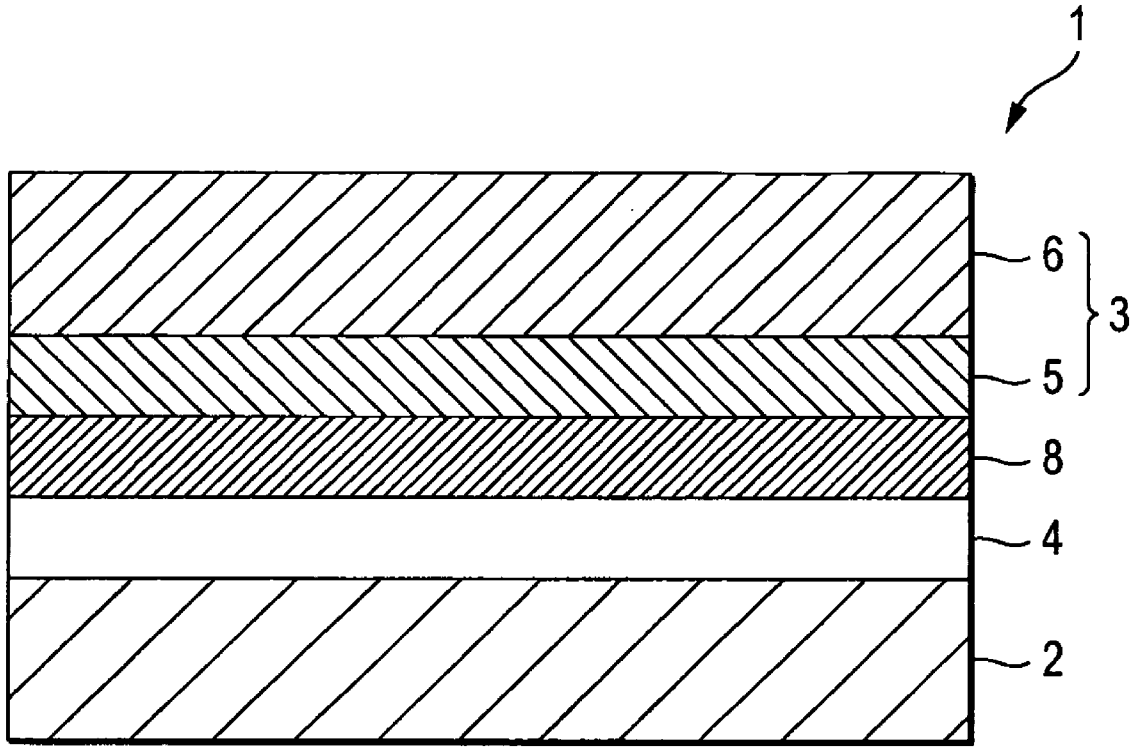
FIG. 8 is a cross-sectional view showing the fourth exemplary embodiment of the electrophotographic photoreceptor of the invention.

FIG. 8. is a cross-sectional view showing the fourth exemplary embodiment of the electrophotographic photoreceptor of the invention.

As is shown in FIG. 8, the electrophotographic photoreceptor 1 has the same constitution as that of the electrophotographic photoreceptor 1 shown in FIG. 6 except for providing an interlayer 8 between the photosensitive layer 3 and the undercoat layer 4. This interlayer 8 is provided for improving electric properties of the electrophotographic photoreceptor 1, improving image quality and improving adhesion properties of the photosensitive layer 3. Materials for constituting the interlayer 8 are not particularly limited and can arbitrarily be selected from among synthetic resins, powders of organic or inorganic substances, and electron-transporting substances.

In the case of constituting the photosensitive layer of the electrophotographic photoreceptor obtained by the invention by two layers (a charge-generating layer and a charge-transporting layer), the thickness of the layer to be disposed at a position higher than the charge-generating layer for obtaining high resolution is preferably 50 μm or less, more preferably 40 μm or less. In the case where the thickness of the charge-transporting layer is as thin as 20 μm or less, a photoreceptor with the constitution wherein a protective layer having the same strength as that of the undercoat layer is disposed on the charge-transporting layer is particularly effectively used.

4. Photosensitive Layer (Charge-Generating Layer)

The charge-generating layer constituting the photosensitive layer is formed by dispersing the charge generating substance of phthalocyanine pigment in an organic solvent together with a binder and coating the dispersion (hereinafter also referred to as "dispersing and coating"). In the case of forming the charge-generating layer by dispersing and coating, the charge-generating substance is dispersed in an organic solvent together with a binder and additives, and the thus-obtained dispersion is coated to form the charge-generating layer.

(1) Charge-Generating Substances

As the charge-generating substance to be used in the charge-generating layer in the electrophotographic photoreceptor of the invention, the aforesaid phthalocyanine pigments are used.

(2) Binders

As binders (binder resins or binding resins) which can be used in the charge-generating layer, the lignophenol derivatives are preferably used.

As other binders which can be used in the charge-generating layer, there are illustrated polycarbonate, polystyrene, polysulfone, polyester, polyimide, polyester carbonate, polyvinylbutyral, methacrylic ester polymers, vinyl acetate homopolymers or copolymers, cellulose ester, cellulose ether, polybutadiene, polyurethane, phenoxy resin, epoxy resin, silicone resin, fluorine-containing resin, and partially cross-linked cured products thereof.

As the binders which can be used in the charge-generating layer, one of these binders may be used independently, or two or more of the binders may be used in combination thereof.

(3) Solvents

As solvents which can be used upon production of the charge-generating layer, there are specifically illustrated methanol, ethanol, n-butanol, benzyl alcohol, acetone, methyl ethyl ketone, cyclohexanone, methyl acetate, n-butyl acetate, dioxane, tetrahydrofuran, methylene chloride, chloroform, toluene, xylene, chlorobenzene, dimethylformamide, dimethylacetamide, and water. As the solvents, one of these solvents may be independently used, or a combination of two or more thereof may be used.

(4) Compounding Amounts

The concentration of solid components of the binder solution is in the range of preferably from 0.1% by weight to 10% by weight, more preferably from 1.0% by weight to 7.0% by weight. When the concentration is within the above-mentioned range, the amount of the charge-generating substance is appropriate, and hence a good sensitivity can be obtained and, since the viscosity of the dispersion is appropriate, productivity upon coating the dispersion for obtaining the photoreceptor is good.

Also, the concentration of solid components of the mixed solution of the charge-generating substance and the solvent is in the range of preferably from 0.1% by weight to 20% by weight, more preferably from 1% by weight to 15% by weight. When the concentration is within the above-mentioned range, there result good coating adhesion and adhesiveness, and a charge-generating layer having excellent sensitivity and cycle stability can be obtained.

Preferably, the charge-generating substance and the solvent are previously subjected to dispersion treatment and, as a method of performing this dispersion treatment, there are illustrated a sand mill, a colloid mill, an attritor, a ball mill, a Dyno mill, a high-pressure homogenizer, an ultrasonic wave dispersing machine, a CoBall mill, and a roll mill.

(5) Coating Methods

As coating methods to be employed for providing the charge-generating layer, conventional methods such as a blade coating method, a wire-bar coating method, a spray coating method, a dip coating method, a bead coating method, an air-knife coating method, and a curtain coating method can be employed. After coating the charge-generating layer, the solvent in the coated layer is removed by drying in a drying machine or by natural drying. The drying temperature and the drying time can arbitrarily be determined.

Also, as the coating methods to be employed for providing the charge-generating layer, a coating method using a dip coating apparatus wherein a coating solution containing dispersed therein the charge-generating substance is circulated is preferred, which apparatus is equipped with a micro-mixer or a micro-reactor in the middle of the circulation system wherein the coating solution is circulated. The micro-mixer or the micro-reactor provided in the middle of the circulation system wherein the coating solution is circulated serves to prevent agglomeration of the phthalocyanine pigment or the filler due to dilution and improve uniformity of the coating solution, and hence it becomes possible to form an excellent coating layer and, in addition, there are obtained excellent aging characteristics.

The micro-mixer and the micro-reactor are apparatuses using a similar micro vessel and have a fundamental structure conventional to each other and, in particular, that which causes chemical reaction upon mixing plural solutions is in some cases called a micro-reactor. Thus, the following descriptions will be given with the presupposition that the micro-mixer includes the micro-reactor.

In recent years, such apparatuses have been attracting attention and are described in detail in, for example, Microreactors New Technology for Modern Chemistry (written by Wolfgang Ehrfeld, Volker Hessel and Holger Loewe; published by WILEY-VHC in year 2000).

The micro-reactor permits to handle micro amounts of materials by mixing in a micro space and to effectively perform temperature control with accuracy. Further, the micro-reactor has an extremely large surface area per unit volume and a small Reynolds' number, and hence the micro-reactor has the characteristic that a laminar flow can easily be formed.

In the micro-mixer or the micro-reactor, the width of the flow passage is preferably 500 μm or less.

As a mixing unit employed in the micro-mixer or the micro-reactor, there can be illustrated various ones as described in Microreactors New Technology for Modern Chemistry, pp. 43-46, and JP-A-2004-33901.

As the micro-mixer or the micro-reactor, there are illustrated, more specifically, micro-reactors described in the publication by Institut fur Mikrotechnik Mainz GmbH, Germany; and those which are sold under the name of Selecto (trade name) and Cytos (trade name) by Cellular Process Chemistry GmbH, Frankfurt/Main. Besides, there can be illustrated those micro-mixers and micro-reactors which are described in WO96/12540, WO96/12541, JP-T-2001-521816 (the term "JP-T" as used herein means a published Japanese translation of a PCT application), JP-A-2002-18271, JP-A-2002-58470, JP-A-2002-90357, JP-A-2002-102681, JP-A-2005-288254, JP-A-2005-37780, and JP-A-2004-33901. In addition to the above-described ones, a caterpillar type mixer manufactured by Institut fur Mikrotechnik Mainz GmbH is known wherein, though the width of the passages is about 1 mm, two kinds of continuous slanted pattern exist in the passages. Additionally, as to materials for these micro-mixers or the micro-reactors, those which are stable against materials to be introduced thereinto are properly selected.

In particular, the micro-mixer or the micro-reactor of Institut fur Mikrotechnik Mainz GmbH as shown in FIGS. 2 and 3 can properly be used.

Figure 9:
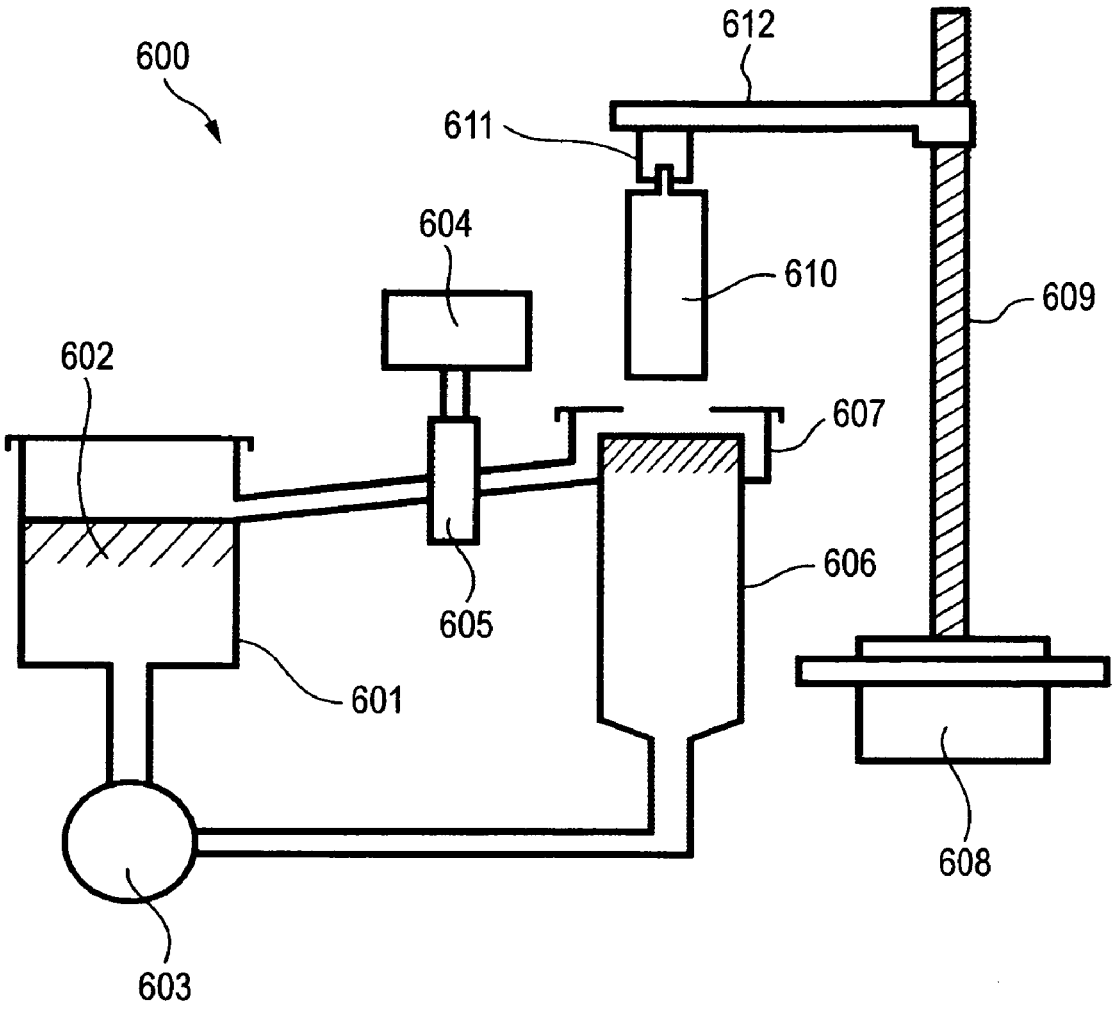
FIG. 9 is a view schematically showing one example of the dip coating apparatus which can be used for producing the electrophotographic photoreceptor of the invention.

As a dip coating apparatus wherein the micro-mixer or the micro-reactor is provided in the middle of the circulation system for circulating the coating solution, an apparatus is preferred which has at least the structure shown in FIG. 9.

FIG. 9 is a schematic view showing the structure of one example of the dip coating apparatus which can be used for producing the electrophotographic photoreceptor of the invention.

In the dip coating apparatus 600 shown in FIG. 9, 601 designates a coating solution reservoir, 602 a coating solution, 603 a pump for circulation, 604 a tank for a diluting solvent, 605 a micro-mixer or micro-reactor, 606 a coating tank, 607 a saucer for the coating solution, 608 an elevating device-driving motor, 609 a screw, 610 a substrate, 611 a holding member, and 612 an elevating member.

Also, in FIG. 9, the substrate 610 is to be dipped in the coating solution retained in the coating tank 606 in a state of being attached to the holding member 611 of the elevating member 612. An overflow of the coating solution from the coating tank is collected by the saucer 607 and is mixed with the diluting solution fed from the tank 604 for the diluting solvent in the micro-mixer or micro-reactor 605, and then flows into the coating solution reservoir 601. The coating solution is fed from the coating solution reservoir 601 to the coating tank 606 by means of the pump 603.

Dilution in the micro-mixer or micro-reactor 605 may not always be performed. It is also possible to automatically control the dilution in such manner that a predetermined amount of the diluting solvent is introduced from the tank 604 for the diluting solvent when a signal is received which signal is generated from a sensor (not shown) provided for monitoring the concentration of the coating solution.

In the aforesaid dip coating apparatus, positions of the tank 604 for the diluting solvent and the micro-mixer or micro-reactor 605 are not limited to those shown in FIG. 9, but may respectively be provided at any positions, such as between the coating solution reservoir 601 and the pump 603 for circulation.

(6) Additives

In addition, for the purpose of preventing deterioration of the photoreceptor by ozone or oxidizing gases generated in the image-forming apparatus or by light or heat, antioxidants, photo-stabilizers and/or heat stabilizers may be added to the photo-sensitive layer of the electrophotographic photoreceptor of the invention.

As the antioxidants, there are illustrated, for example, hindered phenol, hindered amine, p-phenylenediamine, arylalkane, hydroquinone, spirochroman, spiroindanone, and derivatives thereof, organic sulfur compounds, and organic phosphorus compounds.

Specifically, there are illustrated, for example, methylphenol, styrenated phenol, n-octadecyl 3-(3',5'-di-t-butyl-4'-hydroxyphenyl)propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butyridene-bis(3-methyl-6-t-butylphenol), 4,4'-thio-bis(3-methyl-6-t-butylphenol), 1,3,5-tris(4-t-butyl-3-hydroxy-2,6-dimethylbenzyl) isocyanurate, tetrakis[methylene-3-(3',5'-di-t-butyl-4'-hydroxy-phenyl)propionate]methane, and 3,9-bis{2-[3-(3-t-butyl-4-hydroxy-5-methylphenyl) propionyloxy]-1,1-dimethylethyl}-2,4,8,10-tetraoxaspiro [5.5]undecane.

As the hindered amine compounds, there are illustrated bis(2,2,6,6-tetramethyl-4-piperidyl)sebacate, bis(1,2,2,6,6-pentamethyl-4-piperidyl)sebacate, 1-{2-[3-(3,5-di-t-butyl-4-hydroxyphenyl)propionyloxy]ethyl}-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4.5]undecane-2,4-dione, 4-benzoyloxy-2,2,6,6-tetramethylpiperidine, polycondensate between dimethyl succinate and 1-(2-hydroxyethyl)-4-hydroxy-2,2,6,6-tetramethylpiperidine, poly[{6-(1,1,3,3-tetramethylbutyl) imino-1,3,5-triazin-2,4-diyl}{(2,2,6,6-tetramethyl-4-piperidyl)imino}hexamethylene {(2,3,6,6-tetramethyl-4-piperidyl)imino}], bis(1,2,2,6,6-pentamethyl-4-piperidyl) 2-(3,5-di-t-butyl-4-hydroxybenzyl)-2-n-butylmalonate, and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

As the organic sulfur-containing antioxidants, there are illustrated dilauryl 3,3'-thiodipropionate, dimyristyl 3,3'-thiodipropionate, distearyl 3,3'-thiodipropionate, pentaerythritol-tetrakis-(β-lauryl-thiopropionate), ditridecyl 3,3'-thiodipropionate, and 2-mercaptobenzimidazole.

As the organic phosphorus-containing antioxidants, there are illustrated trisnonylphenyl phosphite, triphenyl phosphite, and tris(2,4-di-t-butylphenyl)phosphite.

The organic sulfur-containing antioxidants and the organic phosphorus-containing antioxidants are called secondary antioxidants, and combined use thereof with the phenol series or amine series primary antioxidants can provide synergistic effects.

As the photo-stabilizers, there are illustrated derivatives of benzophenone, benzotriazole, dithiocarbamate, and tetramethylpiperidine.

As the benzophenone series photo-sensitizers, there are illustrated, for example, 2-hydroxy-4-methoxybenzophenone, and 2-hydroxy-4-octoxybenzophenone, 2,2'-di-hydroxy-4-methoxybenzophenone.

As the benzotriazole series photo-sensitizers, there are illustrated 2-(2'-hydroxy-5'-methylphenyl)-benzotriazole, 2-[2'-hydroxy-3'-(3",4",5",6"-tetrahydrofuthalimidomethyl)-5'-methylphenyl]-benzotriazole, 2-(2'-hydroxy-3'-t-butyl-5'-methylophenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)benzotriazole, 2-(2'-hydroxy-5'-t-octylphenyl)benzotriazole, and 2-(2'-hydroxy-3',5'-di-t-amylphenyl)benzotriazole.

As other compounds, there are illustrated 2,4-di-t-butylphenyl 3',5'-di-t-butyl-4'-hydroxybenzoate and nickel dibutyl-dithiocarbamate.

Also, the photo-sensitive layer can contain at least one electron acceptive substance for the purpose of improving sensitivity, reducing residual potential, and reducing fatigue after repeated use.

As the electron acceptive substance which can be used in the invention, there are illustrated, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Of these, fluorenone compounds, quinine compounds and benzene derivatives having an electron attractive group such as —Cl, —CN or —$NO_2$ are particularly preferably used. Further, to the coating solution for forming the photo-sensitive layer may be added a slight amount of silicone oil as a leveling agent for improving smoothness of the coated film.

5. Photo-Sensitive Layer (Charge-Transporting Layer)

The charge-transporting layer is constituted by a charge-transporting substance and a binder.

(1) Charge-Transporting Substances

The charge-transporting layer in the electrophotographic photoreceptor of the invention contains a charge-transporting substance.

The charge-transporting substances to be contained in the charge-transporting layer are not particularly limited, and commonly known substances can be used. For example, there are illustrated hole-transporting substances such as oxadiazole derivatives (e.g., 2,5-bis(p-diethylaminophenyl)-1,3,4-oxadiazole, pyrazoline derivatives (e.g., 1,3,5-triphenylpyrazoline, and 1-[pyridyl(2)]-3-(p-diethylaminostyryl)-5-(p-diethylaminostyryl)pyrazoline), aromatic tertiary amines (e.g., triphenylamine, tri(p-methyl)phenylamine, N,N'-bis(3,4-dimethylphenyl)biphenyl-4-amine, dibenzylaniline, and 9,9-dimethyl-N,N'-di(p-nitrile)fluorenone-2-amine, aromatic tertiary diamino compounds (e.g., N,N'-diphenyl-N,N'-bis(3-methylphenyl)-1,1-biphenyl)-4,4'-diamine), 1,2,4-triazine derivatives (e.g., 3-(4'-dimethylaminophenyl)-5,6-di(4'-methoxyphenyl)-1,2,4-triazine), hydrazone derivatives (e.g., 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone), quinazoline derivatives (e.g., 2-phenyl-4-styryl-quinazoline, benzofuran derivatives (e.g., 6-hydroxy-2,3-di(p-methoxyphenyl)-benzofuran), α-stilbene derivatives (e.g., p-(2,2-diphenylvinyl)-N,N'-diphenylaniline, enamine derivatives, carbazole derivatives (e.g., N-ethylcarbazole), poly-N-vinylcarbazole and derivatives thereof; and electron-transporting substances such as quinine compounds (e.g., chloranil, bramanil, and anthraquinone), tetracyanoquinodimethane compounds, fluorenone compounds (e.g., 2,4,7-trinitrofluorenone and 2,4,5,7-tetranitro-9-fluorenone), oxadiazole compounds (e.g., 2-(4-biphenyl)-5-(4-t-butyllphenyl)-1,3,4-oxadiazole, 2,5-bis(4-naphthyl)-1,3,4-oxadiazole, and 2,5-bis(4-diethylaminophenol)-1,3,4-oxadiazole), xanthone compounds, thiophene compounds, and diphenoquinone compounds (e.g., 3,3',5,5'-tetra-t-butyldiphenoquinone). Further, the charge-transporting substances include polymers which have the fundamental structure of the above-illustrated compound in the main or side chain thereof.

In addition, the charge-transporting substances may be used independently or in combination of two or more thereof.

(2) Binders

Also, the binders to be contained in the charge-transporting layer are not particularly limited, and commonly known ones can be used. However, those which can form an electrically insulating film are preferred. For example, there are illustrated the aforesaid lignophenol derivatives, polycarbonate resin, polyester resin, methacryl resin, acryl resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinylcarbazole, polyvinyl butyral, polyvinyl formal, polysulfone, casein, gelatin, polyvinyl alcohol, ethyl cellulose, phenol resin, polyamide, carboxymethyl cellulose, vinylidene chloride polymer wax, and polyurethane. These binders can be used independently or in combination of two or more thereof. In particular, polycarbonate resin, polyester resin, methacryl resin, and acryl resin are preferably used due to their excellent compatibility with the charge-transporting substance, solubility in solvents and strength.

(3) Compounding Ratio

The compounding ratio (weight ratio) of the binder to the charge-transporting substance can arbitrarily be determined in consideration of deterioration of electrical properties and reduction in film strength. The thickness of the charge-transporting layer is preferably from 5 μm to 50 μm, more preferably from 10 μm to 40 μm.

(4) Production Process

The charge-transporting layer can be formed by mixing the charge-transporting substance, organic solvent, binder, etc. to prepare a coating solution, coating this on the charge-generating layer and, further, drying the coating.

In preparing the coating solution for forming the charge-transporting layer, the charge-transporting material, the organic solvent and the binder are mixed. As methods for highly dispersing the charge-transporting substance in the liquid, dispersing methods of using a roll mill, a ball mill, a vibration mill, an attritor, a sand mill, a colloid mill or a paint shaker can be employed.

Further, from the standpoint of film-forming properties, the size of particles contained in the coating solution for forming the charge-transporting layer is preferably 0.5 μm or less, more preferably 0.3 μm or less, still more preferably 0.15 μm or less. When the size of the particles is 0.5 μm or less, the film-forming properties of the charge-transporting layer is excellent, with image defects being scarcely formed.

Further, as the solvent to be used for the coating solution for forming the charge-transporting layer, conventional organic solvents such as dioxane, tetrahydrofuran, methylene chloride, chloroform, chlorobenzene and toluene can be used independently or in combination of two or more thereof.

As coating methods for forming the charge-transporting layer, conventional methods such as a blade coating method, a wire-bar coating method, a spray coating method, a dip coating method, a bead coating method, an air-knife coating method, and a curtain coating method can be employed.

Also, a preferred coating method to be employed for providing the charge-transporting layer is the method of coating by means of a dip coating apparatus wherein a coating solution containing dispersed therein at least the charge-transporting substance is circulated and wherein a micro-mixer or a micro-reactor is provided in the middle of the circulation system for circulating the coating solution. Uniformity of the coating solution can be improved by providing the micro-mixer or the micro-reactor in the middle of the circulation system for circulating the coating solution, which permits formation of an excellent film and imparts excellent aging properties to the coating solution and the formed film.

6. Photosensitive Layer (Single-Layer Type)

The photosensitive layer formed as a single layer is a layer which contains the lignophenol derivative and, further, the charge-generating substance (phthalocyanine pigment) and the charge-transporting substance to be contained in the charge-generating layer and the charge-transporting layer, respectively. With such single-layer type photosensitive layer, the content of the phthalocyanine pigment is preferably from 0.1% by weight to 50% by weight, more preferably from 1% by weight to 20% by weight, based on the total weight of the photosensitive layer. When the content is within the range, there can be obtained an appropriate sensitivity, with no problems such as reduction in chargeability being caused.

Also, with such single-layer type photosensitive layer, polycarbonate resin and methacryl resin are particularly preferably used as the binder from the standpoint of compatibility with the hole-transporting substance. Further, as such resin, a proper one may be selected to use from among organic photoconductive materials such as poly-N-vinylcarbazole, polyvinylanthracene, polyvinylpyrene, and polysilane. Additionally, the above-mentioned binders may be used independently or in combination of two or more. This photosensitive layer can also be formed by mixing the above-described charge-generating substance, the charge-transporting substance, the organic solvent, and the binder to prepare a coating solution, coating the solution on a conductive substrate according to the above-described methods, and then drying the coating.

As coating methods for forming the single-layer type photosensitive layer, conventional methods such as a blade coating method, a wire-bar coating method, a spray coating method, a dip coating method, a bead coating method, an air-knife coating method, and a curtain coating method can be employed.

Also, a preferred coating method to be employed for providing the single-layer type photosensitive layer is the method of coating by means of a dip coating apparatus wherein a coating solution containing dispersed therein at least the lignophenol derivative, the charge-generating substance, and the charge transporting substance is circulated and wherein a micro-mixer or a micro-reactor is provided in the middle of the circulation system for circulating the coating solution. Uniformity of the coating solution can be improved by preventing agglomeration of the phthalocyanine pigment or fillers due to dilution by providing the micro-mixer or the micro-reactor in the middle of the circulation system for circulating the coating solution, which permits formation of an excellent film and imparts excellent aging properties to the coating solution and the formed film.

7. Conductive Substrate

Conductive substrates are not particularly limited as long as they have electrical conductivity and, for example, there can be used a drum, sheet or plate of metal such as aluminum, copper, iron, zinc or nickel. In addition, a drum-shaped, sheet-shaped or plate-shaped substrate obtained by vacuum-depositing a metal such as aluminum, copper, gold, silver, platinum, palladium, titanium, nickel-chromium, stainless steel or copper-indium on a polymer-made sheet, paper, plastic or glass to impart electric conductivity can be used as well. Further, a drum-shaped, sheet-shaped or plate-shaped substrate obtained by vacuum-depositing a conductive metal compound such as indium oxide, or by laminating a metal foil, on a polymer-made sheet, paper, plastic or glass to impart electric conductivity can be used as well. Still further, besides these substrates, a drum-shaped, sheet-shaped or plate-shaped substrate obtained by dispersing carbon black, indium oxide, tin oxide-antimony oxide powder, metal powder or copper iodide in a binder, and coating the dispersion on a polymer-made sheet, paper, plastic or glass to impart electric conductivity can be used as well.

Here, in the case of using a metal pipe as the conductive substrate, the surface may be remained as such, but it is preferred to previously subject the surface thereof to such treatment as mirror cutting, etching, anodizing, rough cutting, centerless grinding, sandblasting, wet horning or coloring treatment. The surface treatment to roughen the surface of the substrate serves to prevent formation of grain-like density spots which can be formed in the case of using a coherent light source such as a laser beam due to coherent light within the photoreceptor.

8. Undercoat Layer

Also, the electrophotographic photoreceptor of the invention preferably has an undercoat layer between the conductive substrate and the photosensitive layer and, more preferably, the undercoat layer contains inorganic particles. The undercoat layer thus provided serves to prevent injection of charge from the support into the photosensitive layer, prevent image defects such as black points and white points, and improve adhesion between the conductive substrate and the photosensitive layer to thereby improve durability. In addition, the inorganic particles contained in the undercoat layer serve to stabilize environmental properties and repeatable properties and prevent formation of interference fringes.

In addition, the undercoat layer plays an important role with respect to prevention of image defects, and is an important functional layer for suppressing image defects caused by defects or stains of the substrate or by coating defects or uneven coating of the photosensitive layer. The undercoat layer is formed by, more preferably, dispersing the aforesaid surface-coated metal oxide particles, a binder and additives to prepare a coating solution for forming the undercoat layer, and coating the coating solution on the conductive substrate.

(1) Metal Oxide Particles

In the invention, as the metal oxide particles, conductive powders of 0.5 μm or less in particle size are preferably used. The term "particle size" as used herein means an average primary particle size. The undercoat layer is required to have an appropriate resistance for acquiring leak resistance. Thus, the metal oxide particles preferably have a powder resistance of from about $10^2$ to about $10^{11}$ Ωcm. Among them, particles of a metal oxide such as titanium oxide, zinc oxide or tin oxide having the above-mentioned resistance value are preferably used. Within the above-described range, there can be obtained an excellent leak resistance, and an increase in residual potential can be suppressed. The metal oxide particles may be used independently or in combination of two or more thereof.

Surface treatment of the metal oxide particles with a surface-treating agent is preferred because it serves to improve wetting properties of the metal oxide particles to resin and compatibility of the particles with resin, thus dispersibility of the particles into resin being improved. The term "surface treatment of the metal oxide particles" as used herein means to react the surface of the metal oxide particles with a surface-treating agent to thereby coat at least part of the surfaces of metal oxide particles.

As compounds to be used as the surface-treating agents in the invention, there are illustrated, for example, organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; reactive organometallic compounds such as antimony alkoxides, germanium alkoxides, indium alkoxides, indium chelate compounds, manganese alkoxides, manganese chelate compounds, tin alkoxide compounds, tin chelate compounds, aluminum silicon alkoxides, aluminum titanium alkoxides, and aluminum zirconium alkoxides; and silane coupling agents, though the surface-treating agents not being limited only to these. Of these organometallic compounds, organic zirconium compounds, organic titanyl compounds, organic aluminum compounds, particularly zirconium alkoxide compounds, zirconium chelate compounds, titanium alkoxide compounds, titanium chelate compounds and/or silane coupling agents, provide a low residual potential and show good electrophotographic properties, thus being preferably used. In particular, silane coupling agents are more preferred in the point of improving electrical properties, environmental stability, and image quality.

As the silane coupling agents, any one may be used as long as it can provide desired electrophotographic properties. As specific examples of the silane coupling agents, there are illustrated vinyltrimethoxysilane, γ-methacryloxypropyl-tris (β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane which, however, are not limitative at all. These silane coupling agents may be used independently or in combination of two or more thereof.

The surface treatment of the metal oxide particles may be conducted in a solvent.

As such solvent, any solvent can be selected from among aromatic compounds, halogenated hydrocarbons, ketones, ketone alcohols, ethers, and esters. For example, there can be used conventional organic solvents such as xylene, toluene, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, and chlorobenzene. The solvents to be used here may be used independently or in combination of two or more thereof.

In the invention, the amount of the surface-treating agent for the metal oxide particles is preferably an amount which is enough to provide desired electrophotographic properties. The electrophotographic properties are influenced by the amount of the surface-treating agent adhering to the metal oxide particles after the surface treatment. In the case of using the silane coupling agent, the adhering amount is determined from Si intensity and from intensity of a major metal element of the metal oxide in the fluorescent X-ray analysis. A preferred Si intensity in the fluorescent X-ray analysis is in the range of from $1.0\times10^{-5}$ to $1.0\times10^{-2}$ of the intensity of a major metal element of the metal oxide. Within the above-described range, injection of charge from the undercoat layer into the photosensitive layer (charge-generating layer) and remaining of residual potential are suppressed and, thus, there can be obtained excellent image quality.

Also, the metal oxide particles having been surface-treated in the micro-reactor may be subjected to baking treatment. Such baking treatment serves to fully complete the dehydration condensation reaction of the surface-treating agent. The baking treatment can be performed at any temperature as long as desired electrophotographic properties are obtained but, in the case of using the aforesaid surface-treating agents, the baking is performed at a temperature of preferably 100° C. or above, more preferably from 150° C. to 250° C. When the temperature is within the above-described range, dehydration condensation reaction of the surface-treating agent can be fully completed without thermally decomposing the surface-treating agent. Next, as needed, the surface-treated metal oxide particles are milled. Agglomerates of the metal oxide particles can be milled by the milling, which serves to improve dispersing properties of the metal oxide particles in the undercoat layer.

(2) Binders

As binders (binder resins or binding resins) for the coating solution for forming the undercoat layer, commonly known high-molecular resin compounds such as the aforesaid lignophenol derivatives, acetal resins (e.g., polyvinyl butyral), polyvinyl alcohol resin, casein, polyamide resin, cellulose resin, gelatin, polyurethane resin, polyester resin, methacryl resin, acryl resin, polyvinyl chloride resin, polyvinyl acetate resin, vinyl chloride-vinyl acetate-maleic anhydride resin, silicone resin, silicone-alkyd resin, phenol resin, phenol-formaldehyde resin, melamine resin, and urethane resin; charge-transporting resins having a charge-transporting group; and conductive resins (e.g., polyaniline) can be used. Of these, those resins are preferably used which are insoluble in the coating solvent for the upper layer and, in particular, phenol resin, phenol-formaldehyde resin, melamine resin, urethane resin, and epoxy resin are preferably used. The ratio of the metal oxide particles in the coating solution for forming the undercoat layer to the binder can arbitrarily be determined within the range wherein desired electrophotographic properties can be obtained.

(3) Additives

Various additives can be used in the coating solution for forming the undercoat layer for the purpose of improving electrical properties, environmental stability and image quality. As the additives, there can be used commonly known materials such as electron-transporting compounds such as quinone compounds (e.g., chloranil, bromanil and anthraquinone), tetracyanoquinodimethane compounds, fluorenone compounds (e.g., 2,4,7-trinitrofluorenone and 2,4,5,7-tetranitro-9-fluorenone), oxadiazole compounds (e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone compounds, thiophene compounds, and diphenoquinone compounds (e.g., 3,3',5,5'-tetra-t-butyldiphenoquinone); polycyclic condensed compounds; electron-transporting pigments such as azo compounds; zirconium chelate compounds; titanium chelate compounds; aluminum chelate compounds; titanium alkoxide compounds; organic titanium compounds; and silane coupling agents. Among them, acceptor type compounds such as electron-transporting compounds and electron-transporting pigments are preferred.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimmer, tetra-(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethyl acetoacetate aluminum diisopropylate, and aluminum tris(ethylacetoacetate).

The silane coupling agents are used for surface-treating the metal oxide particles and, further, they can be added to the coating solution as additives. Specific examples of the silane coupling agents to be used here include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

These additives may be used independently or in combination of two or more thereof. In addition, they may be used as a mixture or polycondensate of plural compounds.

The amount of the additives in the undercoat layer is preferably from 0.1 to 10 parts by weight based on the amount of the metal oxide particles to be used. When the amount is within the above-mentioned range, dispersing properties and coating adaptability are improved, and the effects of improving sensitivity, reducing residual potential and reducing fatigue upon repeated use can be obtained, thus such amount being preferred.

(4) Solvents

As solvents for preparing the coating solution for forming the undercoat layer, commonly known organic solvents can be used. For example, proper solvents can arbitrarily be selected from among alcohols, aromatic hydrocarbons, halogenated hydrocarbons, ketones, ketone alcohols, ethers, and esters. For example, organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene can be used. These solvents to be used for dispersion can be used independently or as a mixture of two or more thereof. In the case of using the solvents as a mixture, solvents to be used may be any solvents that can dissolve the binder as a mixed solvent.

(5) Dispersing Method

As methods for dispersing the metal oxide particles in the binder, there can be employed methods of using, respectively, a roll mill, a ball mill, a vibration ball mill, an attritor, a sand mill, a colloid mill, and a paint shaker.

(6) Coating Method

As coating methods to be employed for providing the undercoat layer, conventional methods such as a blade coating method, a wire-bar coating method, a spray coating method, a dip coating method, a bead coating method, an air-knife coating method, and a curtain coating method can be employed. The undercoat layer can be formed on the conductive substrate by using the thus-obtained coating solution for forming the undercoat layer. The solvent in the undercoat layer is preferably removed, after coating, by drying in a drier or by air-drying. The drying temperature and the drying time can arbitrarily be determined as the case demands.

(7) Hardness, Thickness and Surface Roughness of the Surface of the Undercoat Layer The undercoat layer has a hardness of preferably 35 or more in Vickers hardness. Further, the undercoat layer has a thickness of preferably 15 μm or more, more preferably from 20 μm to 50 μm. Further, the surface roughness of the undercoat layer is adjusted to ¼n (n being the refractive index of the upper layer) of the wavelength λ of a laser to be used for exposure for the purpose of preventing moire image. Resin particles may be added to the undercoat layer for the purpose of adjusting the surface roughness.

As such resin particles, silicone rein particles and cross-linked type polymethyl methacrylate (PMMA) resin particles can be used.

Also, the undercoat layer can be abraded for adjusting the surface roughness. As abrading methods, buff abrasion, sandblast treatment, wet horning, and cutting treatment can be used.

9. Interlayer

An interlayer may be provided between the undercoat layer and the photosensitive layer for the purpose of improving electrical properties, image quality, image quality-maintaining properties, and adhesion properties to the photosensitive layer. Materials for constituting the interlayer are not particularly limited, and can arbitrarily be selected from among powders of synthetic resins, organic substances or inorganic substances and from electron-transporting substances.

(1) Compounds Contained in the Interlayer

Compounds contained in the interlayer include high-molecular resin compounds such as acetal resin (e.g., polyvinylbutyral), polyvinyl alcohol resin, casein, polyamide resin, cellulose resin, gelatin, polyurethane resin, polyester resin, methacryl resin, acryl resin, polyvinyl chloride resin, polyvinyl acetate resin, vinyl chloride-vinyl acetate-maleic anhydride resin, silicone resin, silicone-alkyd resin, phenol-formaldehyde resin, and melamine resin and, in addition, organometallic compounds containing, respectively, zirconium, titanium, aluminum, manganese, and silicon atom. These compounds may be used independently or as a mixture of plural compounds or as a polycondensate. Among them, zirconium- or silicon-containing organometallic compounds have excellent properties of, for example, leaving a low residual potential, suffering less change in potential due to environment and suffering less change in potential due to repeated use.

Examples of the silicone compounds include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Of these, silane coupling agents such as vinyltriethoxysilane, vinyltris(2-methoxyethoxysilane), 3-methacryloxypropyltrimethoxysilane, 3-glycidoxypropyltrimethoxysilane, 2-(3,4-epooxucyclohexyl)ethyltrimethoxysilane, N-2-(aminoethyl)-3-aminopropyltrimethoxysilane), N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chlorpropyltrimethoxysilane are silicon compounds to be particularly preferably used.

Examples of the organic zirconium compounds include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the organic titanium compounds include tetraisopropyl titanate, tetra-n-butyl titanate, butyl titanate dimmer, tetra(2-ethylhexyl)titanate, titanium acetylacetonate, polytitanium actyl acetonate, titanium octylene glycolate, titanium lactate ammonium salt, titanium lactate, titanium lactate ethyl ester, titanium triethanol aminate, and polyhydroxy titanium stearate.

Examples of the organic aluminum compounds include aluminum isopropylate, monobutoxyaluminum diisopropylate, aluminum butyrate, diethylacetoacetate aluminum diisopropylate, and aluminum tris(ethyl acetoacetate).

(2) Additives

In the interlayer may be added fine powders of various organic or inorganic compounds for the purpose of improving electrical properties and light-scattering properties. In particular, white pigments such as titanium oxide, zinc oxide, zinc flower, zinc sulfide, white lead, and lithopone, inorganic pigments as extender pigments such as alumina, calcium carbonate, and barium sulfate, polytetrafluoroethylene resin particles (e.g., particles including resins such as "Teflon (trade name)" manufactured by E.I. du Pont de Nemours & Co. Inc.), benzoguanamine resin particles, and styrene resin particles are effective.

The particle size of the powders to be added is from 0.01 μm to 2 μm. The powders are added as needed, and the addition amount thereof is preferably from 10% by weight to 90% by weight, more preferably from 30% by weight to 80% by weight, based on the total weight of solid components of the interlayer.

It is also effective to incorporate in the interlayer the electron-transporting substances and electron-transporting pigments having heretofore been descried from the standpoint of reducing the residual potential and improving environmental stability. The interlayer functions not only to improve coating properties of a layer (e.g., photosensitive layer) to be formed on or above the interlayer but to act as an electrically blocking layer. However, in case when the thickness is too large, electrical barrier properties become so strong that an increase in potential due to desensitization or repeated use is caused. Therefore, in the case of forming the interlayer, the thickness thereof is preferably from 0.1 μm to 3 μm.

Upon preparation of a coating solution for forming the interlayer, in the case of adding powdery substances, they are added to a solution containing dissolved therein the resin component, followed by dispersing treatment. As methods for the dispersing treatment, methods of using a roll mill, a ball mill, a vibration ball mill, an attritor, a sand mill, a colloid mill or a paint shaker can be employed. Further, this interlayer can be formed by coating a coating solution for forming the interlayer on the conductive substrate, and drying it. As the coating method, conventional methods such as a blade coating method, a wire-bar coating method, a spray coating method, a dip coating method, a bead coating method, an air-knife coating method, and a curtain coating method can be employed.

The interlayer functions not only to improve coating properties of a layer to be formed on the interlayer but to act as an electrically blocking layer. However, in case when the thickness is too large, electrical barrier properties become so strong that an increase in potential due to desensitization or repeated use is caused. Therefore, in the case of forming the interlayer, the thickness thereof is preferably from 0.1 μm to 3 μm. The solvent in the interlayer is preferably removed, after coating, by drying in a drier or by air-drying. The drying temperature and the drying time can arbitrarily be determined.

10. Protective Layer

The protective layer is used for preventing chemical change of the charge-transporting layer upon charging the electrophotographic photoreceptor and for more improving mechanical strength of the photosensitive layer 6. This protective layer can be formed by coating on the photosensitive layer a coating solution containing a conductive material in an appropriate binder.

This protective layer has a structure of, for example, a curable resin, a siloxane resin cured film containing the charge-transporting substance, and the conductive material in an appropriate binder resin. As the curable resin, any commonly known resins may be used and, for example, there are illustrated phenol resin, polyurethane resin, melamine resin, diallyl phthalate resin, and siloxane resin. With the siloxane resin cured film containing the charge-transporting substance, any commonly known materials can be used as the charge-transporting substances. For example, there are illustrated those which are shown in JP-A-10-95787, JP-A-10-251277, JP-A-11-32716, JP-A-11-38656, and JP-A-11-236391, which, however, are not limitative at all.

In the case where the protective layer has a structure wherein the conductive material is contained in an appropriate binder resin, the conductive material is not particularly limited and is exemplified by metallocene compounds such as N,N'-dimethylferrocene, aromatic amine compounds such as N,N'-diphenyl-N,N'-bis(3-methylphenyl)-(1,1'-biphenyl)-4,4-diamine, molybdenum oxide, tungsten oxide, antimony oxide, tin oxide, titanium oxide, indium oxide, carrier of solid solution between tin oxide and antimony or between barium sulfate and antimony oxide, mixtures of the above-described metal oxides, mixtures wherein the above-described metal oxide is mixed into single particles of titanium oxide, tin oxide, zinc oxide or barium sulfate, and particles obtained by coating the above-described metal oxide on the single particles of titanium oxide, tin oxide, zinc oxide or barium sulfate.

As binders which can be used for this protective layer, commonly known resins such as polyamide resin, polyvinyl acetal resin, polyurethane resin, polyester resin, epoxy resin, polyketone resin, polycarbonate resin, polyvinyl ketone resin, polystyrene resin, polyacrylamide resin, polyimide resin, polyamide-imide resin can be used. These can be cross-linked to use as needed.

The protective layer can contain an antioxidant. Specific examples of the antioxidant include, as phenolic antioxidants, 2,6-di-t-butyl-4-methylphenol, styrenated phenol, n-octadecyl 3-(3',5'-di-t-butyl-4'-hydroxyphenyl)propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butyrydene-bis(3-methyl-6-t-butylphenol), 4,4'-thio-bis(3-methyl-6-t-butylphenol), 1,3,5-tris(4-t-butyl-3-hydroxy-2,6-dimethylbenzyl)isocyanurate, tetrakis[methylene-3-(3',5'-di-t-butyl-4'-hydroxyphenyl)propionate]methane, and 3,9-bis{2-[3-(3-t-butyl-4-hydroxy-5-methylphenyl)propionyloxy]-1,1-dimethylethyl}-2,4,8,10-tetraoxaspiro[5.5]undecane.

As the hindered amine compounds, there are illustrated bis(2,2,6,6-tetramethyl-4-piperidyl)sebacate, bis(1,2,2,6,6-pentamethyl-4-piperidyl)sebacate, 1-{2-[3-(3,5-di-t-butyl-4-hydroxyphenyl)propionyloxy]ethyl}-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4.5]undecane-2,4-dione, 4-benzoyloxy-2,2,6,6-tetramethylpiperidine, polycondensate between dimethyl succinate and 1-(2-hydroxyethyl)-4-hydroxy-2,2,6,6-tetramethylpiperidine, poly[{6-(1,1,3,3-tetramethylbutyl)imino-1,3,5-triazine-2,4-diyl}{(2,2,6,6-tetramethyl-4-piperidyl)imino}hexamethylene{(2,3,6,6-tetramethyl-4-piperidyl)imino}], bis(1,2,2,6,6-pentamethyl-4-piperidyl)2-(3,5-di-t-butyl-4-hydroxybenzyl)-2-n-butylmalonate, and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

As the organic sulfur-containing antioxidants, there are illustrated dilauryl 3,3'-thiodipropionate, dimyristyl 3,3'-thiodipropionate, distearyl 3,3'-thiodipropionate, pentaerythritol-tetrakis-(β-lauryl-thiopropionate), ditridecyl 3,3'-thiodipropionate, and 2-mercaptobenzimidazole.

As the organic phosphorus-containing antioxidants, there are illustrated commonly known antioxidants such as tris-nonylphenyl phosphite, triphenyl phosphite, and tris(2,4-di-t-butylphenyl)phosphate and, in addition, those antioxidants which have a functional group capable of binding to a siloxane resin, such as a hydroxyl group, an amino group or an alkoxysilyl group.

The thickness of the protective layer is preferably from 1 μm to 20 μm, more preferably from 1 μm to 10 μm. As coating methods for forming the protective layer, conventional methods such as a blade coating method, a wire-bar coating method, a spray coating method, a dip coating method, a bead coating method, an air-knife coating method, and a curtain coating method can be employed.

As solvents to be used in the coating solution for forming the protective layer, conventional organic solvents such as dioxane, tetrahydrofuran, methylene chloride, chloroform, chlorobenzene, and toluene can be used independently or as a mixture of two or more thereof, and those solvents which sparingly dissolve the photosensitive layer on which this coating solution is coated are preferred.

II. Process Cartridge and Image-Forming Apparatus

Next, a process cartridge of the invention and an image-forming apparatus of the invention which carry the electrophotographic photoreceptor of the invention will be described below.

The process cartridge of the invention is characterized in that it is equipped with the electrophotographic photoreceptor of the invention and at least one unit selected from the group consisting of a charging unit for charging the electrophotographic photoreceptor, a latent-image-forming unit for forming a latent image on the electrophotographic photoreceptor, a developing unit for forming a toner image by developing the latent image with a toner, and a cleaning unit for removing the toner remaining on the surface of the electrophotographic photoreceptor.

Also, the image-forming apparatus of the invention is characterized in that it is equipped with the electrophotographic photoreceptor of the invention, a charging unit for charging the electrophotographic photoreceptor, a latent-image-forming unit for forming a latent image on the electrophotographic photoreceptor, a developing unit for forming a toner image by developing the latent image with a toner, a transferring unit for transferring the toner image to a recording medium, and a fixing unit for removing the toner remaining on the surface of the electrophotographic photoreceptor.

The electrophotographic photoreceptor of the invention can be carried on an image-forming apparatus such as a laser printer, a digital copier, an LED printer, and a laser facsimile which emit a near-infrared light or a visible light or on a process cartridge to be provided in such image-forming apparatus. As to the laser beam, a laser which emits a light of from 350 nm to 800 nm is preferred for obtaining a high definition image. Further, as to the laser beam, the spot diameter is preferably $1\times10^4$ $\mu m^2$ or less, more preferably $3\times10^3$ $\mu m^2$ or less.

Also, the electrophotographic photoreceptor of the invention allows one to use any of one-component or two-component, normal or reversal developing agents. Further, the particle size of the toner particles for obtaining a high definition image is preferably 10 μm or less, more preferably 8 μm or less. Such toners can be obtained by commonly known production methods and, in particular, spherical toners obtained by the dissolution suspension method or the polymerization method are preferably used. In addition, to the toner may be added a surface-lubricating agent (metal salt of fatty acid) or particles exerting abrading effects.

The electrophotographic photoreceptor of the invention can provide good properties of causing less current leakage even when carried on a contact-charge type image-forming apparatus using a charging roller or a charging brush.

Figure 10:
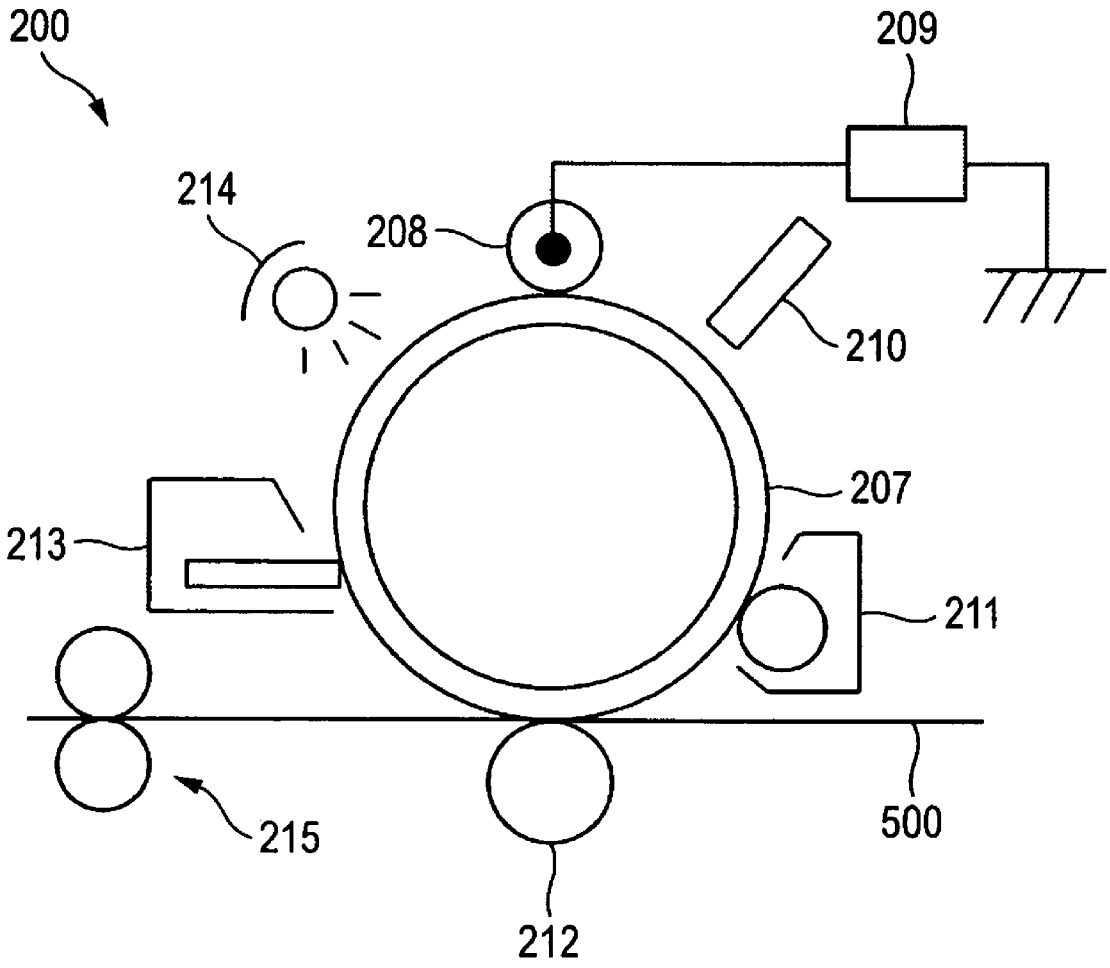
FIG. 10 is a cross-sectional view schematically showing the fundamental constitution of one exemplary embodiment of the image-forming apparatus of the invention.

FIG. 10 is a cross-sectional view schematically showing the fundamental structure of one preferred exemplary embodiment of the image-forming apparatus of the invention.

The image-forming apparatus 200 shown in FIG. 10 is equipped with an electrophotographic photoreceptor 207, a charging unit 208 for charging the electrophotographic photoreceptor 207 by the corona discharge system, such as corotron or scorotron, a power source 209 connected to the charging unit 208, an exposing unit 210 for exposing the electrophotographic photoreceptor 207 charged with the charging unit 208 to thereby form an electrostatic latent image, a developing unit 211 for developing with a toner the electrostatic latent image formed by the exposing unit 210 with a toner to thereby form a toner image, a transferring unit 212 for transferring the toner image formed by the developing unit 211 onto a toner image-receiving medium, a cleaning unit 213, an electrostatic charge remover 214, and a fixing unit 215.

Figure 11:
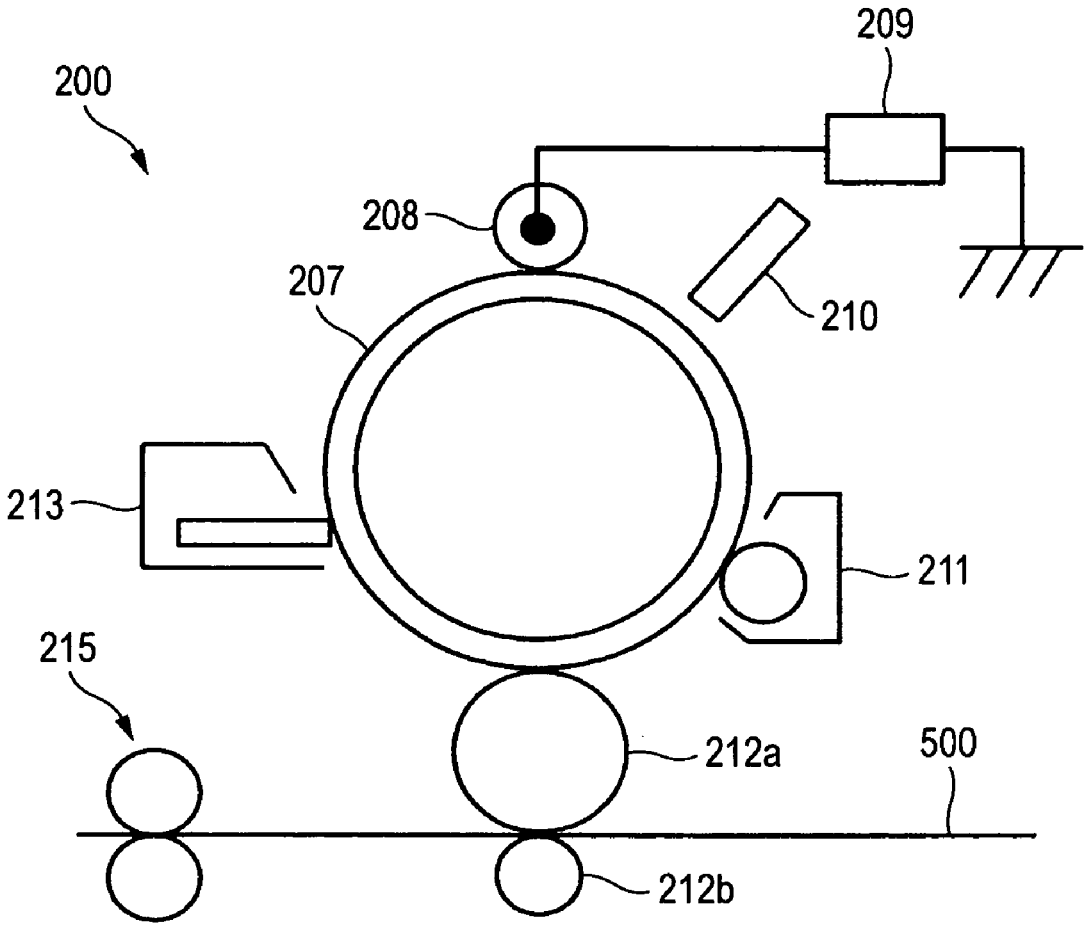
FIG. 11 is a cross-sectional view schematically showing the fundamental constitution of another preferred exemplary embodiment of the image-forming apparatus of the invention shown in FIG. 10.

Also, FIG. 11 is a cross-sectional view schematically showing the fundamental structure of another preferred exemplary embodiment of the image-forming apparatus of the invention shown in FIG. 10.

The image-forming apparatus 200 shown in FIG. 11 has the same structure as the image-forming apparatus 200 shown in FIG. 10 except for having a charging unit 208 which charges the electrophotographic photoreceptor 207 in a contacting manner. In particular, in an image-forming apparatus which employs a contact-type charging unit to which is applied a voltage obtained by superposing an AC voltage on a DC voltage, the photoreceptor can preferably be used due to its excellent abrasion resistance. Additionally, in this type apparatus, the electrostatic charge remover 214 may not be provided in some cases.

The charging unit (charging member) 208 is disposed in contact with the surface of the electrophotographic photoreceptor 207 and functions to uniformly apply a voltage to the photoreceptor and to charge the surface of the photoreceptor to a predetermined potential level. As materials for the charging unit 208, there can be used a metal such as aluminum, iron or copper, a conductive high-molecular material such as polyacetylene, polypyrrole or polythiophene, a dispersion of carbon black, copper iodide, silver iodide, zinc sulfide, silicon carbide or a metal oxide in an elastomer such as polyurethane rubber, silicone rubber, epichlorohydrin rubber, ethylene propylene rubber, acryl rubber, fluorine-containing rubber, styrene-butadiene rubber or butadiene rubber.

Examples of the metal oxide include ZnO, SnO2, TiO2, In2O3, MoO3, and composite oxides thereof. As the charging unit 208, those which are obtained by incorporating a perchlorate in the elastomer material to impart electrical conductivity may also be employed.

Further, a coating layer may be provided on the surface of the charging unit 208. As materials for forming the coating layer, N-alkoxymethylated nylon, cellulose resin, vinylpyridine resin, phenol resin, polyurethane, polyvinyl butyral, and melamine are used independently or in combination thereof. Also, emulsion resin series materials such as acryl resin emulsion, polyester resin emulsion, polyurethane and, in particular, emulsion resins obtained by soap-free emulsion polymerization can be employed.

In these resins may further be dispersed conductive particles for adjusting resistivity, and an antioxidant may be incorporated therein for preventing deterioration. In addition, in order to improve film-forming properties upon forming the coating layer, a leveling layer or a surfactant may be incorporated in the emulsion resin. Further, as a shape of the contact-charging member, there are illustrated a roller shape, a blade shape, a belt shape, and a brush shape.

Further, the electrical resistance value of the charging unit 208 is in the range of preferably from $10^2$ to $10^{14}$ Ωcm, more preferably from $10^2$ to $10^{12}$ Ωcm. The voltage to be applied to this contact-charging member may be of a direct current or an alternate current. The voltage may also be applied in the form of a direct current voltage+an alternate current voltage.

Figure 12:
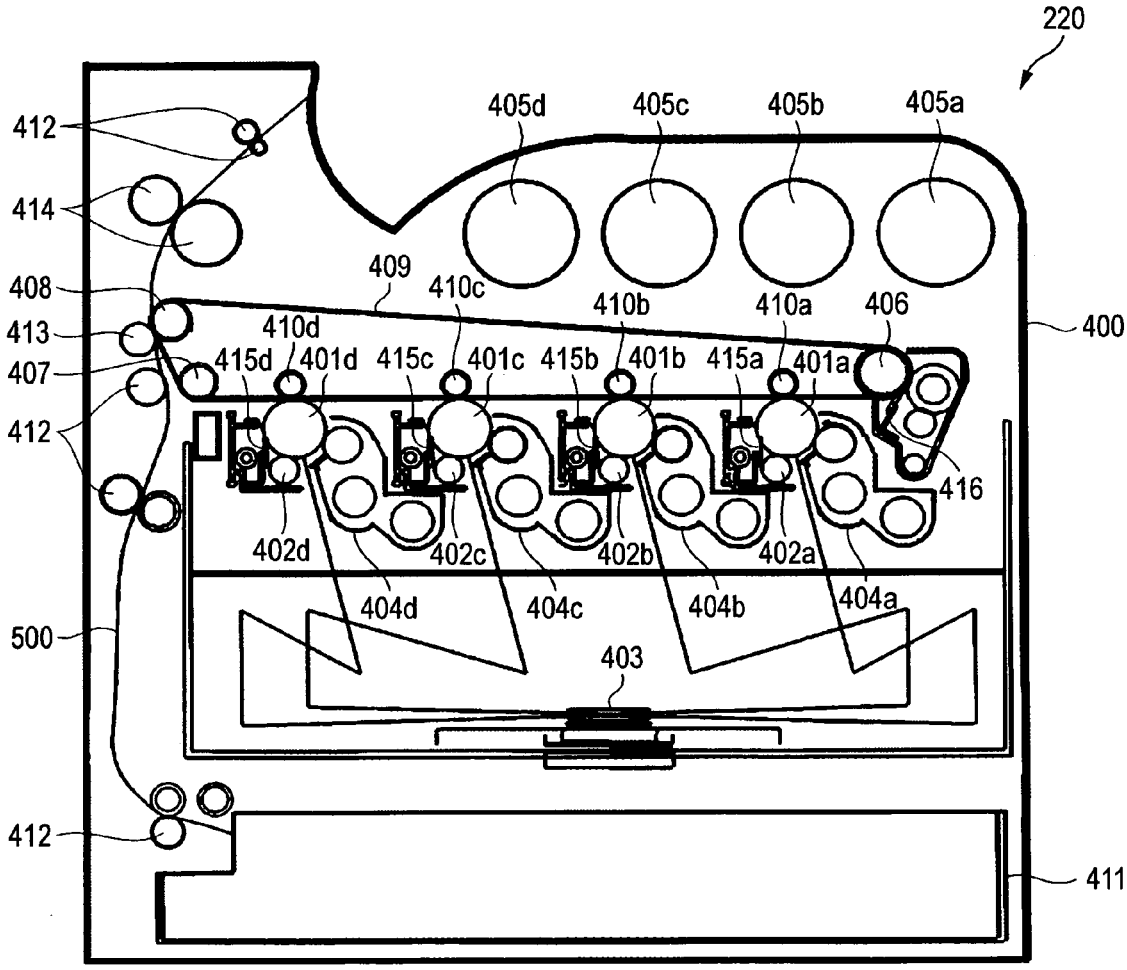
FIG. 12 is a cross-sectional view schematically showing the fundamental constitution of a full-color printer which is one of the image-forming apparatuses of the invention.

FIG. 12 is a cross-sectional view schematically showing the fundamental structure of a further different preferred exemplary embodiment of the image-forming apparatus of the invention shown in FIG. 10.

The image-forming apparatus 220 shown in FIG. 12 is an image-forming apparatus of an intermediate transfer system. Inside the housing 400, 4 electrostatic photoreceptors 401*a* to 401*d* (for example, photographic photoreceptors 401*a*, 401*b*, 401*c*, and 401*d* being capable of forming an image composed of yellow color, an image composed of magenta color, an image composed of cyan color, and an image composed of black color, respectively) are disposed in parallel to each other along an intermediate transfer belt 409.

Here, the individual electrophotographic photoreceptors 401*a* to 401*d* carried on the image-forming apparatus 220 are the electrophotographic photoreceptors of the invention. For example, it is preferred for the apparatus to carry any of the aforesaid electrophotographic photoreceptors shown in FIGS. 5 to 8. Each of the electrophotographic photoreceptors 401*a* to 401*d* are rotatable in a predetermined direction (counter-clockwise on the paper), and charging rolls 402*a* to 402*d*, developing unit 404*a* to 404*d*, first transfer rolls 410*a* to 410*d*, and cleaning blades 415*a* to 415*d* are respectively disposed along the direction of the rotation of the photoreceptors. To developing apparatuses 404*a* to 404*d* can be fed, respectively, black, yellow, magenta, and cyan, four color toners retained in toner cartridges 405*a* to 405*d*. The first transfer rolls 410*a* to 410*d* are respectively in contact with the electrophotographic photoreceptors 401*a* to 401*d* via the intermediate transfer belt 409.

Further, a laser light source (latent-image-forming unit (exposing unit)) 403 is disposed at a predetermined position within the housing 400 so as to irradiate the surfaces of the electrophotographic photoreceptors 401*a* to 401*d* with the laser light emitted from the laser light source 403. Thus, during rotation step of the electrophotographic photoreceptors 401*a* to 401*d*, individual steps of charging, exposing, developing, first transferring, and cleaning are performed in sequence to thereby transfer and superimpose toner images of individual colors one upon the other on the intermediate transfer belt 409.

The intermediate transfer belt 409 is supported with a predetermined tension by means of a driving roll 406, a backup roll 408, and a tension roll 407 and can be rotated with no loosening. Also, a second transfer roll 413 is disposed in contact with the backup roll 408 via the intermediate transfer belt 409. The intermediate transfer belt 409 having passed between the backup roll 408 and the second transfer roll 413 is surface-cleaned by means of, for example, a cleaning blade 416 disposed in the vicinity of a driving roll 406, and is then repeatedly subjected to the subsequent image-forming process.

Also, a tray (a tray for image-receiving media) 411 is provided at a predetermined position within the housing 400, and an image-receiving medium 500 such as paper in the tray 411 is transported, by means of transporting rolls 412, between the intermediate transfer belt 409 and the second transfer roll 413 and, further, between two fixing rolls 414 in contact with each other, and is then discharged out of the housing 400.

Additionally, though the above descriptions have been given by reference to the case of using the intermediate transfer belt 409 as an intermediate transfer body, the intermediate transfer body may be of a belt-like shape like the intermediate transfer belt 409 described above or of a drum-like shape. As resin materials to be used as substrates for the intermediate transfer body in the belt shape, conventionally known resins can be used. For example, there are illustrated resin materials such as polyimide resin, polycarbonate resin (PC), polyvinylidene fluoride (PVDF), polyalkylene terephthalate (PAT), a blend of ethylene/tetrafluoroethylene copolymer (ETFE)/PC, a blend of ETFE/PAT, a blend of PC/PAT, polyester, polyether ether ketone, and polyamide, and resin materials containing these materials as a major component. Further, the resin materials may be blended with an elastic material to use.

As the elastic material, there can be used polyurethane, chlorinated polyisoprene, NBR, chloroprene rubber, EPDM, hydrogenated polybutadiene, butyl rubber, and silicone rubber can be used independently or as a blend of two or more thereof. To the resin materials an the elastic materials to be used as the substrate may be added, as needed, conductive agents for imparting electronic conductivity and conductive agents having ionic conductivity independently or in combination of two or more thereof. Of these, polyimide resin containing dispersed therein a conductive agent is preferred in the point of excellent mechanical strength. As the conductive agents, there can be used carbon black, metal oxides and conductive polymers such as polyaniline.

In the case of employing, as the intermediate transfer body, a belt-like constitution such as the intermediate transfer belt 409, the thickness of the belt is generally preferably from 50 μm to 500 μm, more preferably from 60 μm to 150 μm, but can properly be selected according to the hardness of the material.

For example, with a belt composed of the polyimide resin containing dispersed therein the conductive agent, 5% by weight to 20% by weight of carbon black is dispersed as the conductive agent in a solution of polyamide acid which is a precursor of polyimide, the dispersion is cast onto a metal drum and, after drying, the film peeled from the drum is stretched at an elevated temperature to form a polyimide film, as described in JP-A-63-311263. The above-described film formation can generally be performed by pouring the film-forming solution of the polyamide acid solution containing dispersed therein the conductive agent into a cylindrical metal mold, rotating the cylindrical metal mold at a rotation rate of, for example, from 500 rpm to 2,000 rpm while heating to, for example, from 100° C. to 200° C. to thereby form a film according to the centrifugal molding method and, subsequently, removing the thus-obtained film in a semi-cured state from the mold and placing it around an iron core, followed by heating to a temperature as high as 300° C. or above to cause polyimidation reaction (ring-closing reaction of the polyamide acid) and to complete the curing. In addition, there is an alternative method of forming the polyimide film by casting the film-forming solution on a metal sheet in a uniform thickness, heating the cast solution to a temperature of from 100° C. to 200° C. as is the same as described above to thereby remove most of the solvent, and then stepwise raising the temperature to a temperature as high as 300° C. to form the polyimide film. The intermediate transfer body may have a surface layer.

In the case of employing a drum-shaped constitution as the intermediate transfer body, it is preferable to use, as a substrate, a cylindrical substrate formed of aluminum, stainless steel (SUS) or copper. This cylindrical substrate can be coated with, as needed, an elastic layer, and a surface layer can be formed on the elastic layer.

Figure 13:
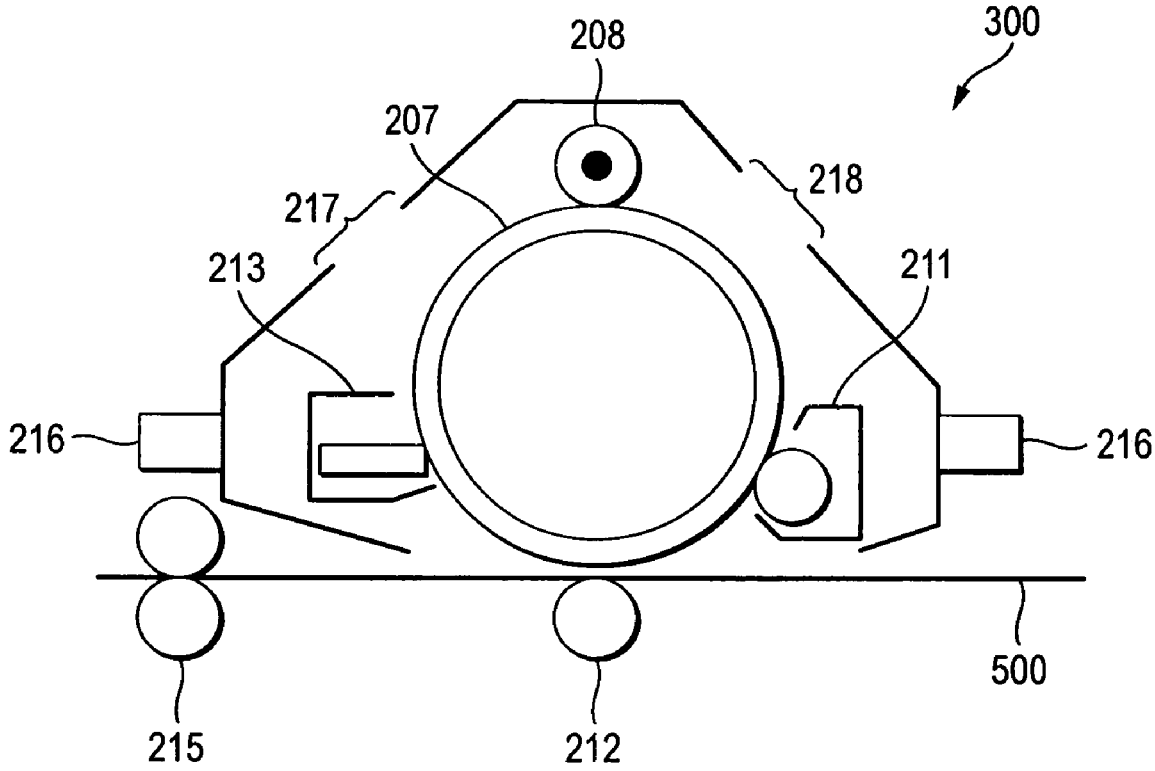
FIG. 13 is a cross-sectional view schematically showing the fundamental constitution of one exemplary embodiment of the process cartridge of the invention.

Further, FIG. 13 is a cross-sectional view schematically showing the fundamental constitution of a preferred exemplary embodiment of the process cartridge of the invention.

The process cartridge 300 is constituted by assembling an electrophotographic photoreceptor 207, a charging unit 208, a developing unit 211, a cleaning device (cleaning unit) 213, an opening 218 for exposure, and a charge remover 214 using an assembling a rail 216 for integration. This process cartridge 300 is to be removably mounted on an image-forming apparatus itself including a transferring unit 212, a fixing device 215, and other constituting members not shown, and constitutes an image-forming apparatus together with the image-forming apparatus itself. Additionally, in the process cartridge 300, the transfer system of the transferring unit 212 is preferably the intermediate transfer system wherein a toner image is first transferred to an intermediate transfer body (not shown), and the first transfer image on the intermediate transfer body is secondarily transferred to an image-receiving medium and, as the transferring unit 212, an intermediate transfer device equipped with the intermediate transfer system is preferred. Likewise, the aforesaid transferring unit in the image-forming apparatus is preferably an intermediate transfer apparatus equipped with the aforesaid intermediate transfer system.

EXEMPLARY EMBODIMENTS

The invention will be described more specifically by reference to Exemplary embodiments and Comparative embodiments. However, the invention is not limited only to the following exemplary embodiments. Additionally, in the following exemplary embodiments, "parts" are by weight.

Synthesis Example 1

Preparation of Lignophenol Derivative

A solution of 3.0 parts of p-cresol in 2.4 parts of acetone is added to 3.0 parts of dried Sugi (*Cryptomeria japonica* D. Don) wood powder degreased with acetone, stirred, tightly closed, and then left overnight. After leaving, acetone is distilled off while stirring with a glass rod to thereby obtain wood powder having p-cresol adsorbed thereon. 4.8 Parts of 72% sulfuric acid is added to the whole amount of the wood powder having p-cresol adsorbed thereon, and quickly stirred with a glass rod and, after the viscosity is decreased, magnetic stirring is performed in the air for 1 hour at room temperature. Subsequently, the reaction mixture is introduced into 300 parts of deionized water under stirring, and the acid is removed under centrifugation till the pH becomes 5 to 6. The centrifugation product is freeze-dried overnight, and the thus-obtained dry product is introduced into 240 parts of acetone and is subjected to magnetic stirring overnight in the air at room temperature in a tightly closed state. This solution is centrifuged, and the brown supernatant is recovered and, after concentrating the supernatant to 70 parts, the concentrate is dropwise added to 210 parts of diethyl ether under cooling with ice. The thus-obtained whitish violet precipitate is collected by centrifugation to remove diethyl ether. Thus, there is obtained a lignophenol derivative (p-cresol being used as the phenol compound) of sugi-ligno-p-cresol.

Synthesis Examples 2 to 5

Preparation of Lignophenol Derivatives

Dry sugi wood powder is treated in the same manner as in Synthesis Example 1 using, as the phenol compound, phenol, catechol, resorcinol and pyrogallol, respectively, to prepare various sugi-lignophenol derivatives. Thus, there are obtained sugi-ligno-phenol (Synthesis Example 2), sugi-ligno-catechol (Synthesis Example 3), sugi-ligno-resorcinol (Synthesis Example 4), and sugi-ligno-pyrogallol (Synthesis Example 5), respectively.

Exemplary Embodiment 1

Preparation of Electrophotographic Photoreceptor Sheet

100 Parts of zinc oxide (average particle size: 70 nm; test sample made by TAYCA CORPORATION; specific surface area value: 15 $m^2/g$) is mixed with 500 parts of toluene under stirring, and 1.25 parts of a silane coupling agent (KBM603; manufactured by Shin-Etsu Chemical Co., Ltd.) is added thereto, followed by stirring the mixture for 2 hours. Thereafter, toluene is distilled off under reduced pressure, and baking is performed at 120° C. for 2 hours to obtain surface-treated zinc oxide.

60 Parts of the surface-treated zinc oxide is mixed with 13.5 parts of a curing agent of blocked isocyanate, Sumijule 3175 (manufactured by Sumitomo Bayer Urethane Co., Ltd.), 38 parts of a solution of 15 parts of a butyral resin of BM-1 (manufactured by Sekisui Chemical Co., Ltd.) in 85 parts by weight of methyl ethyl ketone, and 25 parts of methyl ethyl ketone, and the mixture is dispersed for 2 hours in a sand mill using 1-mmϕ glass beads to obtain a dispersion. To the thus-obtained dispersion are added 0.005 part of dioctyltin dilaurate (as a catalyst) and 3.4 parts of silicone resin particles Tospar 145 (manufactured by GE Toshiba Silicone Co., Ltd.) to obtain a coating solution for forming an undercoat layer. This coating solution is coated on an aluminum substrate having a diameter of 30 mm, a length of 340 mm and a thickness of 1 mm according to the dip coating method, and then dry-cured at 170° C. for 40 minutes to form a 25-μm thick undercoat layer.

Next, a solution of 0.5 part of sugi-ligno-p-cresol prepared in Synthesis Example 1 and 0.5 part of butyral resin BM-S (manufactured by Sekisui Chemical Co., Ltd.) in 100 parts of a mixed solvent of xylene and methyl ethyl ketone (=70:30) is mixed with 1 part of hydroxygallium phthalocyanine crystals described in Example 1 of JP-A-5-263007, and the mixture is dispersed together with 150 parts of glass beads of 1 mm in outer diameter for 5 hours in a sand mill to thereby prepare a coating solution for forming the charge-generating layer. This coating solution is dip coated on the undercoat layer, and heat-dried at 100° C. for 10 minutes to thereby form a 0.20-μm thick charge-generating layer. The dip coating of the coating solution for forming the charge-generating layer is performed by using the dip coating apparatus shown in FIG. 9. That is, in the dip coating apparatus shown in FIG. 9, the coating solution for forming the charge-generating layer is used and, as a diluting solvent, a mixed solvent of xylene and methyl ethyl ketone (=70:30) is prepared in the tank 604 for the diluting solvent. The coating solution is dip coated on the undercoat layer while feeding the mixed solvent to the micro-mixer 605 in an amount of 0.01% by weight/min based on the amount of the whole coating solution. Thus, the charge-generating layer is formed.

Further, 4 parts of a charge-transporting substance of N,N'-diphenyl-N,N'-bis(3-methylphenyl)-1,1'-biphenyl-4,4'-diamine, 6 parts of a binder resin of bisphenol Z type polycarbonate resin of 30,000 in viscosity average molecular weight, 80 parts of tetrahydrofuran, and 0.2 part of 2,6-di-t-butyl-4-methylphenol are mixed to prepare a coating solution for forming the charge-transporting layer. This coating solution is dip coated on the charge-generating layer and heat-dried at 120° C. for 40 minutes to thereby form a 25-μm thick charge-transporting layer. Thus, an intended electrophotographic photoreceptor sheet is obtained.

[Preparation of Electrophotographic Photoreceptor Drum]

A 30 mmϕ×404 mm aluminum pipe of 1 mm in thickness is subjected to liquid horning treatment using an abrasive (alumina beads; CB-A30S; average diameter $D_{50}$=30 μm; manufactured by Showa Titanium Co., Ltd.) to roughen the surface so that center-line roughness Ra becomes 0.18 μm. The thus surface-roughened pipe is used as a conductive substrate and, in the same manner as with the above-described electrophotographic photoreceptor sheet, the undercoat layer, the charge-generating layer, and the charge-transporting layer are formed in this order to thereby prepare an intended electrophotographic photoreceptor drum.

The dip coating of the coating solution for forming the charge-generating layer is performed by using the dip coating apparatus shown in FIG. 9. That is, in the dip coating apparatus shown in FIG. 9, the coating solution for forming the charge-generating layer is used and, as a diluting solvent, a mixed solvent of xylene and methyl ethyl ketone (=70:30) is prepared in the tank 604 for the diluting solvent. The coating solution is dip coated on the undercoat layer while feeding the mixed solvent to the micro-mixer 605 in an amount of 0.01% by weight/min based on the amount of the whole coating solution, followed by drying at 100° C. for 5 minutes to thereby form a 0.15 μm-thick charge-generating layer.

Exemplary Embodiments 2 to 5

In the same manner as in Exemplary embodiment 1 except for using, respectively, 0.5 part of the lignophenol derivatives prepared in Synthesis Examples 2 to 5 in place of 0.5 part of sugi-lingo-p-cresol prepared in Synthesis Example 1, there are obtained electrophotographic photoreceptors (electrophotographic photoreceptor sheets and electrophotographic photoreceptor drums) which are respectively referred to as Exemplary embodiments 2 to 5.

Exemplary Embodiment 6

In the same manner as in Exemplary embodiment 1 except for changing the amount of sugi-ligno-p-cresol prepared in Exemplary embodiment 1 from 0.5 part to 0.0001 part, there is obtained electrophotographic photoreceptors (an electrophotographic photoreceptor sheet and an electrophotographic photoreceptor drum) which are referred to as Exemplary embodiment 6.

Exemplary Embodiment 7

In the same manner as in Exemplary embodiment 1 except for changing the amount of sugi-ligno-p-cresol prepared in Synthesis Example 1 from 0.5 part to 2.0 parts, there is obtained electrophotographic photoreceptors (an electrophotographic photoreceptor sheet and an electrophotographic photoreceptor drum) which are referred to as Exemplary embodiment 7.

Comparative Embodiment 1

Electrophotographic photoreceptors (an electrophotographic photoreceptor sheet and an electrophotographic photoreceptor drum) are prepared in the same manner as in Exemplary embodiment 1 except for not using sugi-ligno-p-cresol and changing the amount of the butyral resin BM-S (manufactured by Sekisui Chemical Co., Ltd.) from 0.5 part to 1 part.

[Test for Evaluating Electrophotographic Characteristic Properties of the Electrophotographic Photoreceptors]

(1) Evaluation of Characteristic Properties at the Initial Stage of Use

In order to evaluate electrophotographic characteristic properties of the electrophotographic photoreceptor sheets obtained in Exemplary embodiments 1 to 7 and Comparative embodiment 1, electrophotographic characteristic properties are measured according to the following procedures.

First, each photoreceptor is negatively charged by −5.0 kV corona discharge using an electrostatic copy paper tester (EPA8200; manufactured by Kawaguchi Electric Works Co., Ltd.) under the circumstance of 20° C. and 50% RH and using a 20 mmϕ small-area mask. Subsequently, the surface of each photoreceptor is irradiated with a halogen lamp light spectrally filtered to 780 nm by using an interference filter in an irradiation amount of 5.0 μW/cm$^2$. The initial surface potential $V_o$ [V], half decay exposure $E_{1/2}$ [μJ/cm$^2$] at which the surface potential is reduced to ½ of $V_o$, and dark decay ratio (DDR; $\{(V_o-V_1)/V_o\}\times100$ wherein $V_1$ represents the surface potential 1 second after the surface potential is $V_o$) [%] are measured. The results are shown in Table 1.

(2) Evaluation of Repeatability

The above-described procedure of charging, exposure, and removal of charge is repeated 10,000 times, and the initial surface potential $V_o$ [V], half decay exposure $E_{1/2}$ [μJ/cm$^2$] at which the surface potential is reduced to ½ of $V_o$, and dark decay ratio DDR [%] are measured. The results are shown in Table 1.

(3) Evaluation of Image Quality

The electrophotographic photoreceptor drums of Exemplary embodiments 1 to 7 and Comparative embodiment 1 are respectively mounted on full-color laser printers (DocuCentre Color 400; manufacture by Fuji Xerox Co., Ltd.) to evaluate image quality. Occurrence of image defects such as fog and ghost is checked. The results are shown in Table 1. Additionally, in the full-color laser printers, a roller charger (BCR) is employed as the charging device, ROS wherein a 780-nm semi-conductor laser is used is employed as the exposing device, two-component type reversal developing system is employed as the developing system, a roller charger (BTR) is employed as the transfer device, and the belt intermediate transfer system is employed as the transfer system.

micro-syringes equipped with a pump, and are mixed in constant flow amounts in a micro-reactor (manufactured by IMT; ICC-SY15) whose temperature is set to 0° C. by means of an inlet temperature-controlling device, followed by recovering a mixed solution of the first and the second solutions containing synthesized lignophenol. Additionally, in the used micro-reactor, both the first flow passage and the second flow passage have a width of 500 μm and a groove depth of 500 μm, and the length of flow passage after joining is 200 mm, with the flow rate in the first and the second passages being set to 15 ml/h and the flow rate in the passage after joining being set to 30 ml/h.

All of the thus-recovered mixed solution is transferred to a centrifugal tube and was centrifuged at 3,500 rpm at 25° C. for 10 minutes. The reaction mixture separates into an organic phase (upper layer) containing unreacted phenol derivative and a sulfuric acid phase (lower layer) containing dissolved therein hydrocarbons. Subsequently, about 140 parts of diethyl ether is placed in an Erlenmeyer flask, and the cresol layer (upper layer) is added thereto drop by drop under vigorous stirring with a stirrer. In this occasion, the procedure is conducted under cooling the Erlenmeyer flask retaining diethyl ether with ice. After completion of the dropwise addi-

TABLE 1

| | Lignophenol Derivative | | Characteristic Properties of Photoreceptor (Initial) | | | Characteristic Properties of Photoreceptor (After Using 10,000 Times) | | | Image Quality | |
|---|---|---|---|---|---|---|---|---|---|---|
| Electrophotographic Photoreceptor | Process for Preparation | Amount Used (parts) | Vo (V) | $E_{1/2}$ (μJ/cm$^2$) | DDR (%) | Vo (V) | $E_{1/2}$ (μJ/cm$^2$) | DDR (%) | Fog | Positive Ghost |
| Exemplary Embodiment 1 | Synthesis Example 1 | 0.5 | −472 | 0.44 | 5.9 | −461 | 0.53 | 10.2 | not occurred | not occurred |
| Exemplary Embodiment 2 | Synthesis Example 2 | 0.5 | −477 | 0.51 | 9.5 | −452 | 0.65 | 15.1 | not occurred | not occurred |
| Exemplary Embodiment 3 | Synthesis Example 3 | 0.5 | −465 | 0.43 | 8.8 | −449 | 0.57 | 17.7 | not occurred | not occurred |
| Exemplary Embodiment 4 | Synthesis Example 4 | 0.5 | −468 | 0.51 | 10.1 | −442 | 0.64 | 19.0 | not occurred | not occurred |
| Exemplary Embodiment 5 | Synthesis Example 5 | 0.5 | −465 | 0.41 | 11.5 | −454 | 0.53 | 20.1 | not occurred | not occurred |
| Exemplary Embodiment 6 | Synthesis Example 1 | 0.0001 | −474 | 0.57 | 10.7 | −449 | 0.67 | 36.7 | not occurred | not occurred |
| Exemplary Embodiment 7 | Synthesis Example 1 | 2.0 | −474 | 0.60 | 15.3 | −443 | 0.71 | 13.8 | not occurred | not occurred |
| Comparative Embodiment 1 | — | 0 | −467 | 0.64 | 15.1 | −434 | 0.87 | 38.8 | occurred | occurred |

As is shown in Table 1, it has been confirmed that the electrophotographic photoreceptors of the invention have a high photosensitivity, excellent electrophotographic properties, excellent dispersibility, and can provide good image quality without causing such phenomena as fog and ghost.

Synthesis Example 6

Synthesis of lignocresol is performed using a micro-reactor of the same constitution as the treating apparatus shown in FIG. 1.

First, 0.2 part of wood powder (Japanese cypress as a conifer wood) of 50 μm in median diameter mill-treated in a centrifugal mill (ZM-200) manufactured by Retsch at a rotation number of 16,000 rpm is mixed with 4.1 parts of p-cresol to prepare a first solution (fluid). Also, a 72% concentrated sulfuric acid is prepared as a second solution. The thus-obtained first and second solutions are respectively placed in tion of the organic phase to diethyl ether, several parts of p-cresol is added to the centrifugal tube to wash out surface-active substances and, after well shaking, centrifugation is conducted under the same condition as described above, and the organic phase is dropwise added to diethyl ether. This procedure is repeated three times. The diethyl ether solution is stirred till substances dispersed therein precipitate and the supernatant (diethyl ether) becomes clear (about 1 hour), and the supernatant (diethyl ether) is removed by decantation. The insoluble product is further washed twice with about 11 parts of diethyl ether. Acetone (about 63 parts) is added to the washed insoluble product, followed by stirring till lignin in the precipitate is completely dissolved into acetone. When the precipitate becomes whitish and dispersed in the solution, the insoluble product is removed by centrifugation (5° C.; 3,500 rpm; 10 min), and the acetone solution containing dissolved therein lignin is transferred to an eggplant type flask. After concentrating till the whole volume is reduced to about ⅛, the concentrate is dropwise added to a large excess of diethyl ether. The precipitated fraction is recovered by centrifugation and, after washing with diethyl ether, the solvent is distilled off, followed by drying to obtain purified lignocresol (hinoki-ligno-p-cresol wherein "hinoki" means Japanese cypress).

The above-described procedures of synthesizing lignophenol are repeated 5 times (Synthesis Examples 6-1 to 6-5) to confirm reproducibility. Yields of obtained lignocresol are shown in Table 2.

Synthesis Example 7

(1) Adsorption of Cresol

The water content of degreased wood powder is previously measured, and 1,000 parts (in terms of absolute dry weight) of 20 mesh-pass wood powder (Japanese cypress as a conifer wood) is placed in a stainless steel-made tank. About 5,500 parts of an acetone solution containing 3 mols of p-cresol per mol of lignin $C_9$ unit is added thereto, fine air bubbles are removed, a lid is put on the tank, and the tank is left overnight. After adsorption, acetone is distilled off in a draft till the level of acetone becomes the upper surface of wood powder. Thereafter, the content is transferred to a stainless steel-made long vat, and the solvent is completely distilled off in a draft under continuous and uniform stirring.

(2) Treatment with a Concentrated Acid

The wood powder having adsorbed thereon p-cresol is divided into 4 equal portions (amount of the wood powder per beaker: 250 parts). Hereinafter, descriptions are given with respect to one beaker. About 1,900 parts of 72% sulfuric acid is added thereto by portions while well stirring with a glass rod. Stirring is conducted vigorously so as to completely contact the wood powder with sulfuric acid. A stirrer is used 10 minutes after addition of sulfuric acid. Stirring is discontinued one hour after the addition of sulfuric acid, and two halves of the mixture are respectively introduced to two Erlenmeyer flasks previously retaining from 2,000 to 3,000 parts of deionized water to thereby discontinue the reaction. Thereafter, deionized water is added thereto till the volume of the reaction solution reaches the same volume as that of 5,000 parts of deionized water, and the mixture is left for 2 days.

(3) Treatment of Removing the Acid

After 2 days, the supernatant of each of 8 Erlenmeyer flasks is recovered by decantation in an Erlenmeyer flask. Again, deionized water is added till the volume of the reaction solution reaches the same volume as that of 5,000 parts of deionized water, and the mixture is left under stirring. After spontaneous precipitation, decantation is again performed, and the precipitate is placed in a dialysis membrane bag. The dialysis membrane bag is placed in a huge vat (72 cm in length, 37 cm in width, and 25 cm in depth), and is kept in a water-running state for about 2 weeks during which the precipitate inside the dialysis membrane bag is stirred every day to thereby remove the acid and excess p-cresol by dialysis. After confirming that the inside of the membrane bag is neutral, city water inside the vat is replaced by deionized water, and the dialyzed product is left for 2 days. The deionized water is again replaced by fresh deionized water, and the dialyzed product is left for 2 days, and then the content inside the membrane bag is confirmed to be neutral, thus the procedure being finished.

(4) Drying of the Acid-Treated Precipitate

The acid-treated precipitate is transferred to two beakers and, after leaving for 3 days, the supernatant is removed by decantation. The precipitate is spread as such on a stainless steel-made vat and is dried for about 5 days in a drying machine set at 40° C., further for two days at 60° C. Thereafter, the precipitate is completely dried with diphosphorus pentoxide.

(5) Extraction with Acetone

The dry solid product obtained in (4) is separated into two portions and placed in two Erlenmeyer flasks, respectively. 3,200 Parts of acetone is added to each flask, followed by stirring for 3 days to extract lignophenol. The extract mixture is centrifuged, and the supernatant is filtered through a glass fiber filter paper (Whatman GF/A manufactured by Whatman Co.). Again, extraction and filtration are conducted in the same manner to obtain an acetone-extracted solution.

(6) Purification

The acetone-extracted solution is concentrated to 20-fold amount with respect to the weight of lignin by means of an evaporator, and the concentrate is dropwise added to a 10-fold amount of benzene:hexane (=2:1) with respect to the concentrate to thereby remove remaining unreacted p-cresol and a low-molecular fraction of lignocresol, followed by leaving overnight. Thereafter, the supernatant is removed by decantation, and the precipitate fraction is recovered by centrifugation, washed 5 times with benzene:hexane (=2:1). Thereafter, the solvent is replaced by diethyl ether, and the precipitate is washed twice. The precipitate is dried for 2 days in a draft in the centrifugal tube as recovered, and then completely dried with diphosphorus pentoxide to obtain a powder of lignocresol (hinoki-ligno-p-cresol).

The above-described procedures for synthesizing lignocresol are repeatedly performed 5 times (Synthesis Examples 7-1 to 7-5) to confirm reproducibility. Yields of obtained lignocresol are shown in Table 2.

[Analysis of Properties of Lignophenol]

(1) Gel Permeation Chromatography (GPC)

About 1 mg of the lignocresol derivative sample is completely dissolved in about 1 ml of finely distilled tetrahydrofuran (THF), and one drop of a p-cresol/tetrahydrofuran (THF) solution is added thereto as an internal standard, followed by filtering through COSMONICE Filter "S" (manufactured by Nacalai Tesque, Inc.). Measurement is performed under the following conditions.

Column: Shodex KF801, KF802, KF803, KF804 (manufactured by Showa Denko K.K.)

Solvent: THF

Flow rate: 1 ml/min

Pressure: 50 kgf/cm$^2$

Detector: UV 280 nm

Sample: 25 μl

The weight average molecular weight, number average molecular weight, and dispersion ratio of each sample are shown in Table 2.

TABLE 2

| Sample | Weight Average Molecular Weight | Number Average Molecular Weight | Dispersion Ratio | Yield (%, based on wood powder) |
|---|---|---|---|---|
| Synthesis Example 6-1 | 22,476 | 4,611 | 4.87 | 27.87 |
| Synthesis Example 6-2 | 22,871 | 4,664 | 4.90 | 27.35 |

TABLE 2-continued

| Sample | Weight Average Molecular Weight | Number Average Molecular Weight | Dispersion Ratio | Yield (%, based on wood powder) |
|---|---|---|---|---|
| Synthesis Example 6-3 | 22,089 | 4,613 | 4.79 | 27.67 |
| Synthesis Example 6-4 | 22,384 | 4,605 | 4.86 | 27.64 |
| Synthesis Example 6-5 | 22,942 | 4,657 | 4.93 | 27.18 |
| Synthesis Example 7-1 | 22,124 | 4,647 | 4.76 | 27.02 |
| Synthesis Example 7-2 | 20,175 | 4,567 | 4.41 | 21.78 |
| Synthesis Example 7-3 | 24,281 | 4,215 | 5.76 | 23.39 |
| Synthesis Example 7-4 | 25,313 | 4,691 | 5.40 | 18.56 |
| Synthesis Example 7-5 | 19,826 | 4,683 | 4.23 | 26.07 |

In comparison with Synthesis Examples 7-1 to 7-5, Synthesis Examples 6-1 to 6-5 using the micro-reactor provide more improved yields and more stably produce the lignophenol derivative with no unevenness in quality such as molecular weight distribution.

Exemplary Embodiments 6 and 7

Electrophotographic photoreceptors (electrophotographic photoreceptor sheets and electrophotographic photoreceptor drums) are prepared in the same manner as in Exemplary embodiment 1 except for using, respectively, 0.5 part of hinoki-ligno-p-cresols prepared in Synthesis Examples 6-3 and 7-3 in place of 0.5 part of sugi-ligno-p-creson prepared in Synthesis Example 1. The thus-prepared samples are referred to as Exemplary embodiments 6 and 7, respectively.

Results of evaluating the electrophotographic characteristic properties are shown in Table 3 below.

TABLE 3

| | Lignophenol Derivative | | Characteristic Properties of Photoreceptor (Initial) | | | Characteristic Properties of Photoreceptor (After Using 10,000 Times) | | | Image Quality | |
|---|---|---|---|---|---|---|---|---|---|---|
| Electrophotographic Photoreceptor | Process for Preparation (Synthesis Example) | Amount Used (parts) | Vo (V) | $E_{1/2}$ (μJ/cm$^2$) | DDR (%) | Vo (V) | $E_{1/2}$ (μJ/cm$^2$) | DDR (%) | Fog | Positive Ghost |
| Exemplary Embodiment 6 | 6-3 | 0.5 | −476 | 0.38 | 7.8 | −458 | 0.43 | 10.8 | not occurred | not occurred |
| Exemplary Embodiment 7 | 7-3 | 0.5 | −470 | 0.35 | 8.1 | −448 | 0.44 | 9.9 | not occurred | not occurred |

What is claimed is:

1. An electrophotographic photoreceptor comprising:

a conductive substrate; and a photosensitive layer that comprises a phthalocyanine pigment, a charge-transporting substance and at least one kind of lignophenol derivative, wherein the at least one kind of lignophenol derivative is selected from the group consisting of the following (a) to (c):

(a) a lignophenol derivative that is a phenol compound of lignin, which is obtained by solvating a lignin-containing material with a phenol compound, adding thereto an acid, and mixing them;

(b) a lignophenol derivative that is a lignophenol second-order derivative, which is obtained by subjecting the lignophenol derivative of (a) to a reaction of introducing an acyl group, a carboxyl group, an amido group or a cross-linkable group or to a reaction of alkali treatment; and (c) a lignophenol derivative that is a lignophenol higher-order derivative, which is obtained by subjecting the lignophenol derivative of (a) to two or more reactions selected from the group consisting of a reaction of introducing an acyl group, a reaction of introducing a carboxyl group, a reaction of introducing an amido group, a reaction of introducing a cross-linkable group and a reaction of alkali treatment.

2. The electrophotographic photoreceptor according to claim 1, wherein the photosensitive layer comprises:

a charge-generating layer that comprises the phthalocyanine pigment and the at least one kind of lignophenol derivative; and a charge-transporting layer that comprises the charge-transporting substance.

3. The electrophotographic photoreceptor according to claim 1, wherein the at least one kind of lignophenol derivative is in an amount of from about 0.00001 part by weight to about 3.0 parts by weight based on 1 part by weight of the phthalocyanine pigment.

4. A process cartridge comprising:

the electrophotographic photoreceptor according to claim 1; and at least one unit selected from the group consisting of a charging unit that charges the electrophotographic photoreceptor, a latent-image-forming unit that forms a latent image on the electrophotographic photoreceptor, a developing unit that forms a toner image by developing the latent image with a toner, and a cleaning unit that removes a toner remaining on a surface of the electrophotographic photoreceptor.

5. An image-forming apparatus comprising:

the electrophotographic photoreceptor according to claim 1;

a charging unit that charges the electrophotographic photoreceptor;

a latent-image-forming unit that forms a latent image on the electrophotographic photoreceptor;

a developing unit that forms a toner image by developing the latent image with a toner;

a transferring unit that transfers the toner image to a recording medium; and a fixing unit that fixes the toner image on the recording medium.

6. An electrophotographic photoreceptor comprising:

a conductive substrate; and a photosensitive layer that comprises a phthalocyanine pigment, a charge-transporting substance, and at least one kind of lignophenol derivative selected from the group consisting of sugi-ligno-p-cresol, sugi-ligno-phenol, sugi-ligno-catechol, sugi-ligno-resorcinol, and sugi-ligno-pyrogallol.

* * * * *